US012492037B2

(12) United States Patent
Switzer

(10) Patent No.: US 12,492,037 B2
(45) Date of Patent: Dec. 9, 2025

(54) ROUND TRIP CONTAINER

(71) Applicant: DS ACQUISITION, LLC, Indianapolis, IN (US)

(72) Inventor: Jack Switzer, Indianapolis, IN (US)

( * ) Notice: Subject to any disclaimer, the term of this patent is extended or adjusted under 35 U.S.C. 154(b) by 0 days.

(21) Appl. No.: 17/941,954

(22) Filed: Sep. 9, 2022

(65) Prior Publication Data

US 2023/0074174 A1 Mar. 9, 2023

Related U.S. Application Data

(60) Provisional application No. 63/242,084, filed on Sep. 9, 2021.

(51) Int. Cl.
*B65D 5/02* (2006.01)
*B65D 5/42* (2006.01)
*B65D 5/54* (2006.01)

(52) U.S. Cl.
CPC ..... *B65D 5/0227* (2013.01); *B65D 5/4237* (2013.01); *B65D 5/541* (2013.01); *B65D 2203/02* (2013.01)

(58) Field of Classification Search
CPC .... B65D 5/0227; B65D 5/4237; B65D 5/541; B65D 2203/02; B65D 81/05; B65D 27/06; B65D 27/16; B65D 33/18; B65D 25/205; B65D 33/20; B65B 51/067; B65B 7/20
USPC ..... 229/132, 301, 305, 223, 221, 233, 68.1; 220/265; 53/412
See application file for complete search history.

(56) References Cited

U.S. PATENT DOCUMENTS

| | | | | |
|---|---|---|---|---|
| 4,434,896 | A * | 3/1984 | Beloate | B65D 5/541 229/102 |
| 4,570,416 | A * | 2/1986 | Shoenfeld | B65D 27/16 283/79 |
| 5,503,328 | A * | 4/1996 | Roccaforte | B65D 27/34 229/80 |
| 6,966,484 | B2 * | 11/2005 | Calonje | B65D 27/06 229/305 |
| 8,590,774 | B1 * | 11/2013 | Sauer | B65D 27/34 229/239 |
| 9,637,275 | B2 * | 5/2017 | Barlas | B65D 33/14 |
| 11,124,331 | B2 * | 9/2021 | Dentino | B65D 27/14 |
| D942,853 | S * | 2/2022 | Sollie | D9/432 |
| 2003/0201315 | A1 * | 10/2003 | Jamison | B65D 5/0227 229/102 |

* cited by examiner

*Primary Examiner* — Christopher R Demeree
(74) *Attorney, Agent, or Firm* — Indiano Law Group, LLC; E. Victor Indiano; John T. Woods, III

(57) ABSTRACT

A round trip container includes a container body having a receiving cavity and an opening. A proximal end of a closure flap is operably coupled with the container body and the closure flap is configured to extend over the opening. A first adhesive receiving area is located on one of the closure flap and the container body and receives adhesive to adhere the closure flap to the container body when the container is placed in a closed "outbound" configuration. An adhesive portion is located on one of the closure flap and the container body. A removable covering is placed over the second adhesive portion. After the package has been received and opened, and any desired contents inserted into the receiving cavity, the covering can be removed and the second adhesive adheres the closure flap to the container body placing the container in a closed "return" configuration.

15 Claims, 37 Drawing Sheets

ROUND TRIP CONTAINER

CROSS-REFERENCE TO RELATED APPLICATIONS

This application claims the benefit of U.S. Provisional Patent Application No. 63/242,084, filed Sep. 9, 2021, the entire contents of which are expressly incorporated herein by reference.

TECHNICAL FIELD OF THE INVENTION

The present application relates to packaging and more particularly, but not exclusively to, a round trip mailing container.

BACKGROUND

Mailing containers are utilized to house various products during shipment. Many mailing containers are single-use or one-way (e.g., only designed to be sent to a single destination) and are discarded once the recipient removes the product therefrom.

A round trip mailing container is designed to be sent to a user, who opens the container and places an item inside. The user then ships the round trip container back to the sender, or to another third-party.

An exemplary round trip container is an outer envelope which includes a return envelope located internal to the outer envelope. As a specific example, a creditor may send an outer envelope that is addressed to a consumer. This outer envelope is an "outbound" container. The outer envelope can include a bill due to be paid as well as a return envelope addressed to the creditor or to a third party (e.g., a payment processing service). After opening the outer envelope, the customer can insert payment and/or payment information into the return envelope and place the return envelope in the mail to be delivered to the creditor. This return envelope is the "return" container.

Some round trip containers are designed for carrying three-dimensional objects, which are often fragile, to either be returned by a consumer to the company or to be sent by the consumer to a third-party warranty provider. These types of round trip containers are frequently utilized for returns and warranty service with various consumer electronics, smartphones, tablets, computers, and the like. When the consumer receives the container, they will open it and insert the defective or unwanted item into the container. The consumer will then close the container, typically with packing tape, and will deliver the container to a shipping carrier to be returned to the company or delivered to a third-party warranty provider.

Prior art round trip n ailing containers are expensive and consumers are typically unwilling to pay an increased cost for goods as a result of packaging. Human intervention is typically required during the preparation of these round trip containers (e.g., in the form of inserting a return label and any padding material into the container). Labor costs contribute significantly to the overall expense of such round trip containers.

Another drawback with known prior art round trip containers is that as the return label is placed within the interior of the container, the containers can only be made up after an order is received from a company. Therefore, ready to ship round trip containers cannot be easily held in inventory as the packaging company would not be able to insert the desired return label within the ready to ship container (e.g., as it is sealed).

It is believed that the demand for round trip containers from various companies various significantly from day to day. For example, with regard to smartphones, consumers often trade-in an older smartphone when a new desirable model becomes available. However, smartphone producers are often unable to accurately determine how many consumers will trade-in an older smartphone for a new popular mode.

One smartphone fulfillment house has seen the required quantity of round trip containers per day vary between around 3,000 containers per day up to around 16,000 containers per day.

Therefore, further technological developments are desirable.

SUMMARY

The present application is directed to round trip railing containers, round trip mailing labels, round trip mailing systems and kits, and methods of forming round trip mailing containers and labels.

One form of the present application is directed to a round trip mailing container having a container body defining a receiving cavity. An opening in the container body provides access to the receiving cavity. A proximal end of a resealable closure flap is operably coupled with the container body, and the resealable closure flap is configured to extend over the opening.

A first adhesive receiving area located at one of the closure flap and the container body. The first adhesive receiving area is configured to receive an adhesive to adhere the closure flap to the container body, when the container is placed in a first closed configuration.

An adhesive portion is located on one of the closure flap and the container body, and a removable covering is disposed over the adhesive portion. In this manner, when the container is placed in the first closed configuration the adhesive portion will not adhere to the container body as the adhesive portion is covered with the removable covering. The second adhesive portion is configured to adhere the closure flap to the container body when the container is placed in a second closed configuration.

The closure flap can include a proximal segment and a distal segment. The first adhesive receiving area can be located at the distal segment, and the adhesive portion can be located at the proximal segment.

The container can include a release located at the closure flap between the proximal segment and the distal segment. The release can take the form of a pull-tab tear away strip. In this form, tearing of the pull-tab tear away strip separates the distal segment from the proximal segment and enables access to the receiving cavity.

The container body can include a substantially rectangular-cuboid shape. The proximal end of the closure flap can be foldably coupled to the top panel. The proximal segment of the closure flap can define a first end of the container body. The container body can include a top panel, a bottom panel, a first side panel, a second side panel, and a second end panel opposite the first end.

An adhesive can be located on the first adhesive receiving area to adhere the distal segment of the closure flap to the bottom panel.

The container can include an inner panel extending upwardly from the bottom panel at the opening. After opening the container with the pull-tab tear away strip, the removable covering can be removed from the adhesive portion and the adhesive portion can adhere the proximal segment to the inner panel to place the container in the second closed configuration.

The container can include a padded insert assembly configured for insertion into the receiving cavity. The padded insert assembly can include two horizontally extending pads which are affixed to and extend between two opposing walls, and wherein the padded insert assembly is configured for mechanized insertion into the receiving cavity.

The container can include a round trip mailing label. This round trip mailing label, also referred to as a combined label (e.g., as it is a combined outbound and return label), can include a first label portion having a face surface that includes first shipment information. The combined label can include a second label portion having a second face surface configured to have second shipment information printed thereon. An adhesive can be located at the second label portion to releasably adhere the second label portion to the first label portion. The second label portion can be configured to be removed from the first label portion and adhered to the container with the adhesive located at the second label portion.

A transparent pouch can retain the combined label, including the first label portion and the second label portion, to the container.

Another form of the present application is directed to an apparatus that includes a first label portion having a face surface configured to have first shipment information printed thereon. This apparatus includes a second label portion having a second face surface configured to have second shipment information printed thereon.

An adhesive is disposed on the second label portion, and the adhesive releasably adheres the second label portion with the first label portion to form a combined label. The second label portion is configured to be removed from the first label portion and adhered to a container.

The apparatus can include a pouch configured to retain the combined label to the container. The pouch can include a viewing window and the face surface can be oriented to be visible through the viewing window.

An outer perimeter of the pouch can be adhered to the container, and the pouch can extend over to fully cover the combined label. The pouch can be configured to enable combined label to be removed therefrom absent tearing the second label portion (e.g., without tearing the second label portion). The pouch can be configured to enable to the entire combined label to be removed therefrom absent tearing.

A lower surface of the first label portion can include a release backing. The adhesive can be located on a second lower surface of the second label portion. The face surface and the second face surface can each face outwardly from the combined label on opposing sides thereof (e.g., a first side of the combined label includes the face surface and a second side of the combined label, opposite the first side, includes the second face surface).

Another form of the present application is directed to a method for forming a round trip container. The method includes stamping a cardboard material sheet to form a unitary die cut including a top panel, a bottom panel, a first side panel, a second side panel, a closure flap having a proximal segment and a distal segment, wherein a proximal end of the closure flap is coupled with the top panel, and an end panel. The method includes providing a tear-away strip between the proximal segment and the distal segment of the closure flap. The method includes placing an adhesive on the proximal segment of the closure flap, wherein a removable covering is located atop the adhesive.

Placing an adhesive on the proximal segment can include affixing a peel and stick adhesive strip to the proximal segment.

The method can include adhering the first side panel to an inner side panel (thereby coupling the side panel and the bottom panel) and forming a container flat.

The method can include orienting the container flat into a three-dimensional container body having an internal receiving cavity, wherein the side panel and the second side panel are approximately perpendicular relative to the top panel and the bottom panel. The method can include placing a mailing label on the container body and affixing a pouch over the mailing label to retain the mailing label to the container body.

The method can include adhering the end panel to an inner end panel and adhering the distal segment to the bottom panel, thereby forming a closed outbound container.

The method can include mechanically inserting an insert into the receiving cavity and mailing the outbound container to a first destination.

The method can include providing a combined mailing label that has a first label portion bearing first shipment information, a second label portion bearing second shipment information, wherein the second label portion includes an adhesive portion, and wherein the second label portion is releasably adhered to the first label portion.

The method can include tearing the tear-away strip and separating the proximal segment and the distal segment. The method can include removing the mailing label from the pouch and peeling the second label portion from the first label portion. The method can include pressing the adhesive portion of the second label portion to an exterior surface of the container body to adhere the second label portion to the exterior surface.

The method can include removing the covering from the peel and stick covered adhesive and pressing the peel and stick adhesive on the closure flap against a first inner end panel and adhering the proximal segment of the closure flap with the first inner end panel, thereby forming a closed return container. The method can include mailing the closed return container to a second destination.

Further embodiments, inventions, forms, objects, features, advantages, aspects, and benefits of the present application are otherwise set forth or become apparent from the description and drawings included herein.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
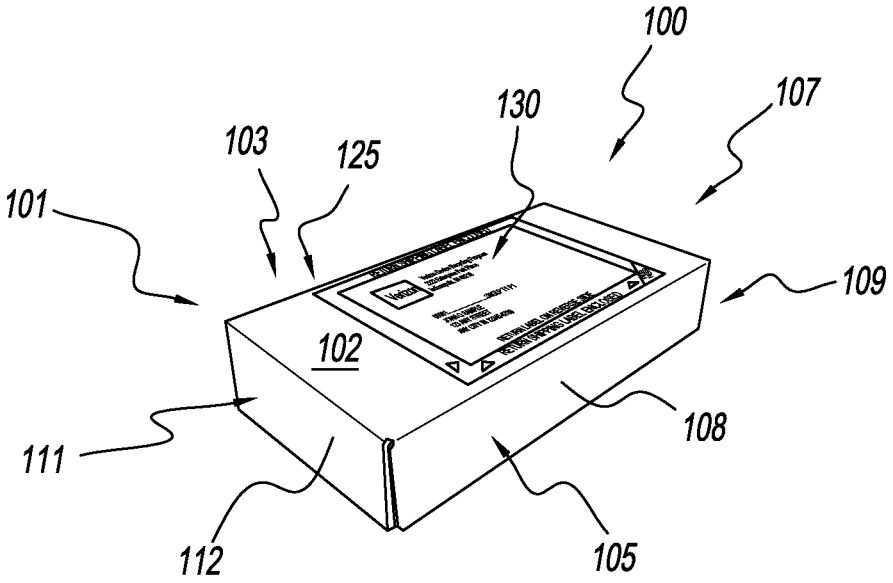
FIG. 1 depicts a perspective view of a resealable round trip container according to a first form of the present application.

For purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

As utilized herein the term "mail" and derivations thereof (e.g., "mailed", "mailing", "mails", etc.) are intended to include all forms of container shipping and/or transport. Exemplary mailing service providers include the U.S. Postal Service, FedEx, UPS, and other shipping carriers, courier services, and post services, as are known.

The term "container" is intended to include a variety of apparatuses in which objects are housed during mailing. Exemplary containers include envelopes, boxes, hard and soft packages and packaging, and other containers which are able to house an item to be mailed.

Referring now to FIGS. 1-3 and 15, an exemplary round trip container assembly 100 will now be described. The round trip container assembly 100 includes a container 103 having a resealable closure flap 111 and a shipping label 130. The container 103 is configured to be mailed from a first user to a first recipient and then the container 103 mailed by the first recipient to a second recipient, who may be the first user (e.g., thereby completing a round trip).

Specifically, the container 103 is configured to be mailed from a first user (e.g., company, warranty provider, third-party service provider, etc.) to a first recipient (e.g., customer, end user, etc.). The container 103 includes an outbound shipping label, which can take the form of label 130. The first user may desire various inserts or padding be inserted into a receiving cavity 1004 container 103, prior to mailing the container 103 to the first recipient. The container 103 is closed with a resealable closure flap 111.

The first recipient opens the sealed container 103. This can be accomplished utilizing a release 302 on the closure flap 111. The first recipient can then insert an object 1504 (e.g., purchase to be returned, product or device to be serviced, etc.) within the receiving cavity 1004 of the container 103. After the object 1504 is placed inside the receiving cavity 1004, the first recipient reseals the container 103 utilizing a resealing adhesive portion 530 that is located on the closure flap 111.

The first recipient places a return label on the container 103 and mails the container to a second recipient (e.g., who may be the first user, a third-party warranty provider, a third-party returns servicer, etc.).

The return label can take the form of label 130 which takes the form of a combined outbound and return label 130. In this preferred form, the first recipient may remove the label 130 from a pouch 132. The first recipient can then remove a return label portion 220 from the outbound label portion 200 and can stick the return label portion 220 on the container 103.

The round trip container 103 can be utilized to house a variety of objects 1504 to be mailed. Exemplary objects 1504 include, but are not limited to, electronics, household goods, clothing, automotive parts, toys, consumer goods, and the like. For example, the round trip container 103 as depicted is believed to be especially suited for the shipment (e.g., to be returned, serviced, traded-in, etc.) of small consumer electronic devices, which include but are not limited to phones, digital recorders, watches such as smart watches, tablets, computers, circuit boards, and the like. The round trip container 103 can be utilized for the return, servicing, and/or trade-in of smartphones, such as iPhones.

It is contemplated that the dimensions and/or shape of the container 103, the dimensions and/or shape of the receiving cavity 1004, and the type and sizing of any inserts or padding may be altered (e.g., changed or modified) by a container 103 manufacturer to accommodate a specific object 1504, or variety of objects 1504, to be mailed therein.

FIGS. 1, 2, and 3-5 depict the round trip container assembly 100 in a closed outbound mailing configuration 107. The container assembly 100 includes a round trip container 103 and a shipping label 130.

The container 103 includes a container body 109 that extends between a first end 113 and a second end 115. The container body 109 houses the object 1504 to be mailed. The container 103 includes a resealable closure flap 111. Although the term "flap" is utilized with regard to closure flap 111, the closure flap 111 does not need to be constructed of thin easily bent material; rather, the term flap is utilized with regard to the closure flap 111 as the closure flap 111 is foldably coupled with the top panel 102.

The resealable closure flap 111 enables the container 103 to be resealed after the container 103 has been opening (e.g., by a first recipient). After the container 103 has been mailed from the first user and received by the first recipient, the first recipient can open the container 103 and insert the object 1504 to be mailed. The first recipient can then reseal the container 103 utilizing the resealable closure flap 111.

Referring back to FIGS. 1-2, the container body 109 can include a substantially rectangular-cuboid shape 101. The exterior 125 of the rectangular-cuboid container 103 is depicted as including a top panel 102, a bottom panel 104, a first side panel 106, and a second side panel 108. The resealable closure flap 111 has a first end panel 112 to cover and close the first end 113. A second end panel 110 is located at the second end 115.

Referring now to FIGS. 1 and 3-5, the resealable closure flap 111 includes a proximal segment 124 and a distal segment 126. The proximal segment 124 is coupled to the top panel 102. The proximal segment 124 includes the first end panel 112 which is depicted as extending over the first end 113 and covering the first end 113 to close the container 103. The distal segment 126 is depicted as being adhesively joined with the bottom panel 104 in the closed outbound configuration 107 of FIG. 3.

A release 302 can be located at the resealable closure flap 111. The release 302 can be located between the proximal segment 124 and the distal segment 126. The release 302 provides for opening of the container 103 through the separation of the proximal segment 124 from the distal segment 126 of the closure flap 111.

Figure 3:
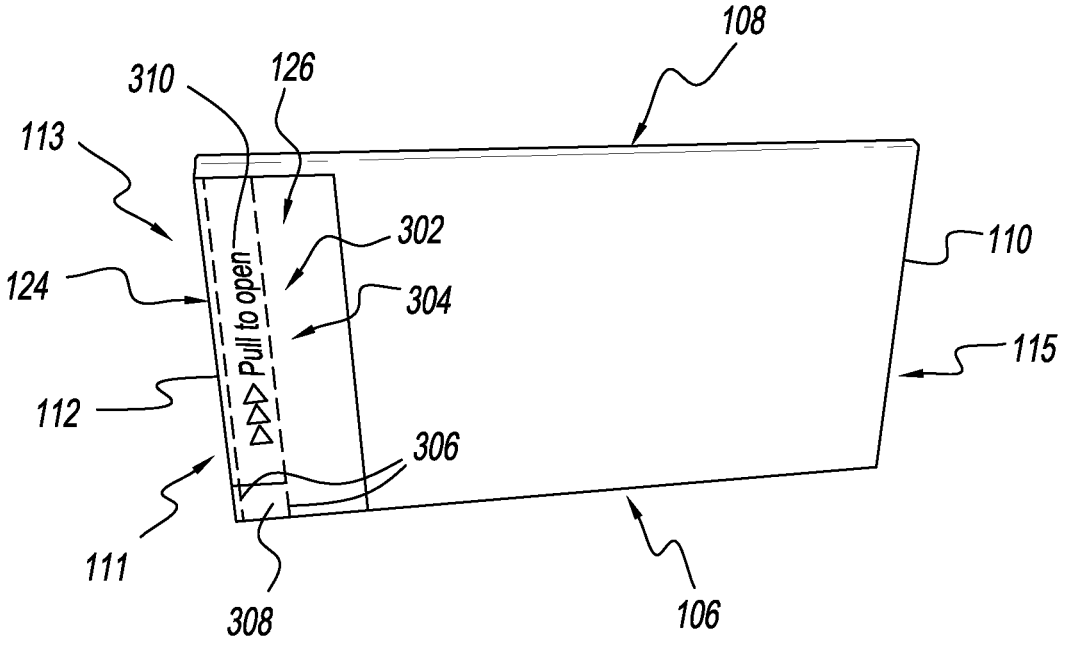
FIG. 3 depicts a bottom view of the container.
Figure 4:
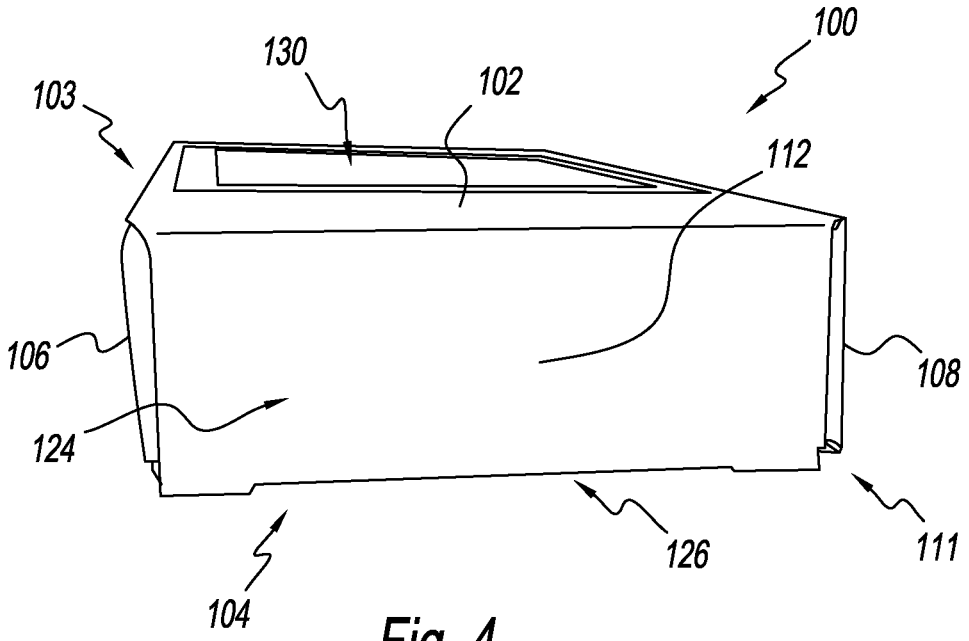
FIG. 4 depicts an end view of the container.

As is best illustrated in FIG. 3, the release 302 can take the form of a pull-tab tear away strip 304. As is known to a person of skill, pull-tab tear away strip 304 includes perforations 306, a pull tab 308, and a tearing strip (not shown) attached to the pull tab and located on a rear surface of the pull-tab tear away strip. To open the first end 113 of the container, the pull tab 308 is pulled upwardly and across the container 103. As the pull tab 308 is pulled, the tearing strip lifts upwardly tearing the perforations 306. This results in the removal of a strip of material across the closure flap 111 and provides for access into the container 103. When the pull-tab tear away strip 304 is torn from the container 103, the proximal segment 124 is separated from the distal segment 126.

However, it is also contemplated that the release 302 can take a variety of forms including a single perforated strip, a dotted line to be cut by a recipient, a tape strip over a physical separation between the proximal segment 124 and the distal segment 126 to be torn off by the recipient, or other release 302 mechanisms as are known to a person of skill. Instructions 310 to utilize the release 302 can be printed on the closure flap 111 or directly on the release 302.

The container body 109 is made of a material 105. In one non-limiting form, the material 105 is a fluted, corrugated cardboard material 105.

Exemplary dimensions for the container body 109 will now be described. It is believed that the following dimensions are well suited for the container 103 to be utilized for mailing mobile phones, including smartphones.

In this exemplary form, the top panel 102 has a length, between the first end 113 and the second end 115, of about 34 centimeters (8.5 inches). The top panel 102 includes a width, between the first side 106 and the second side 108, of about 18 centimeters (4.5 inches). The side panels 106, 108 each include a length, between the first end 113 and the second end 115, of about 17 centimeters (4.5 inches). The side panels 106, 108 each include a width, between the top panel 102 and the bottom panel 104, of about 6.5 centimeters (1.5 inches). The first end panel 112 and the second end panel 110 have a height, between the top panel 102 and the bottom panel 104, of about 3.8 centimeters (1.5 inches). The first end panel 112 and the second end panel 110 have each have a width, between the side panels 106, 108, of approximately 18 centimeters (4.5 inches).

However, it is contemplated that the container body 109 and the container 103 can be formed through a variety of construction techniques and can be formed from a variety of materials depending upon the desired characteristics of the container. The container body 109 and container 103 can include a variety of sizes and shapes, depending upon the specific object 1504 to be mailed and desired characteristics of the container 103.

A shipping label 130 is depicted as being located on the top panel 102 of the container 103. A pouch 132 can be utilized to retain the shipping label 130 to the top panel 102.

Figure 2:
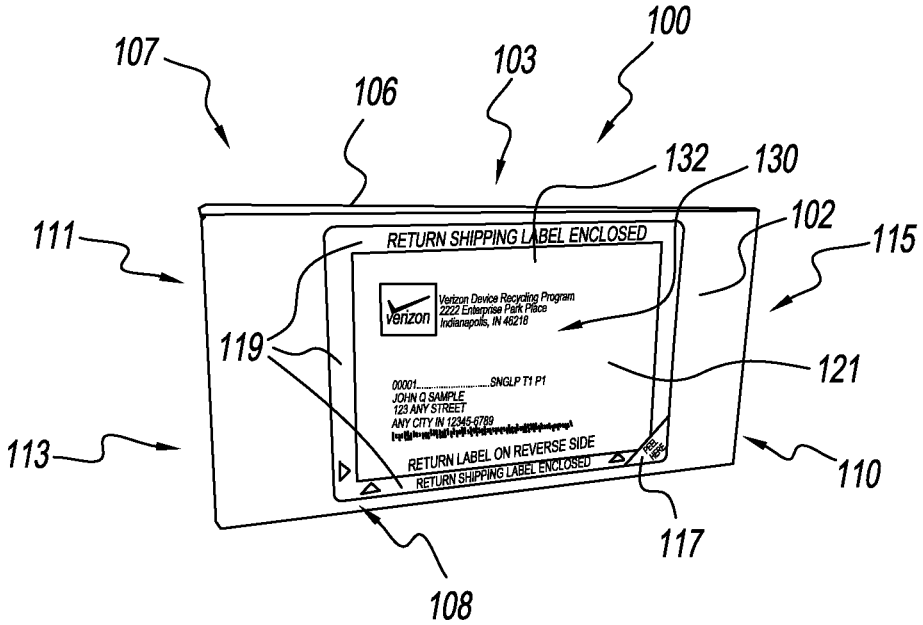
FIG. 2 depicts a top view of the container of FIG. 1.
Figure 2A:
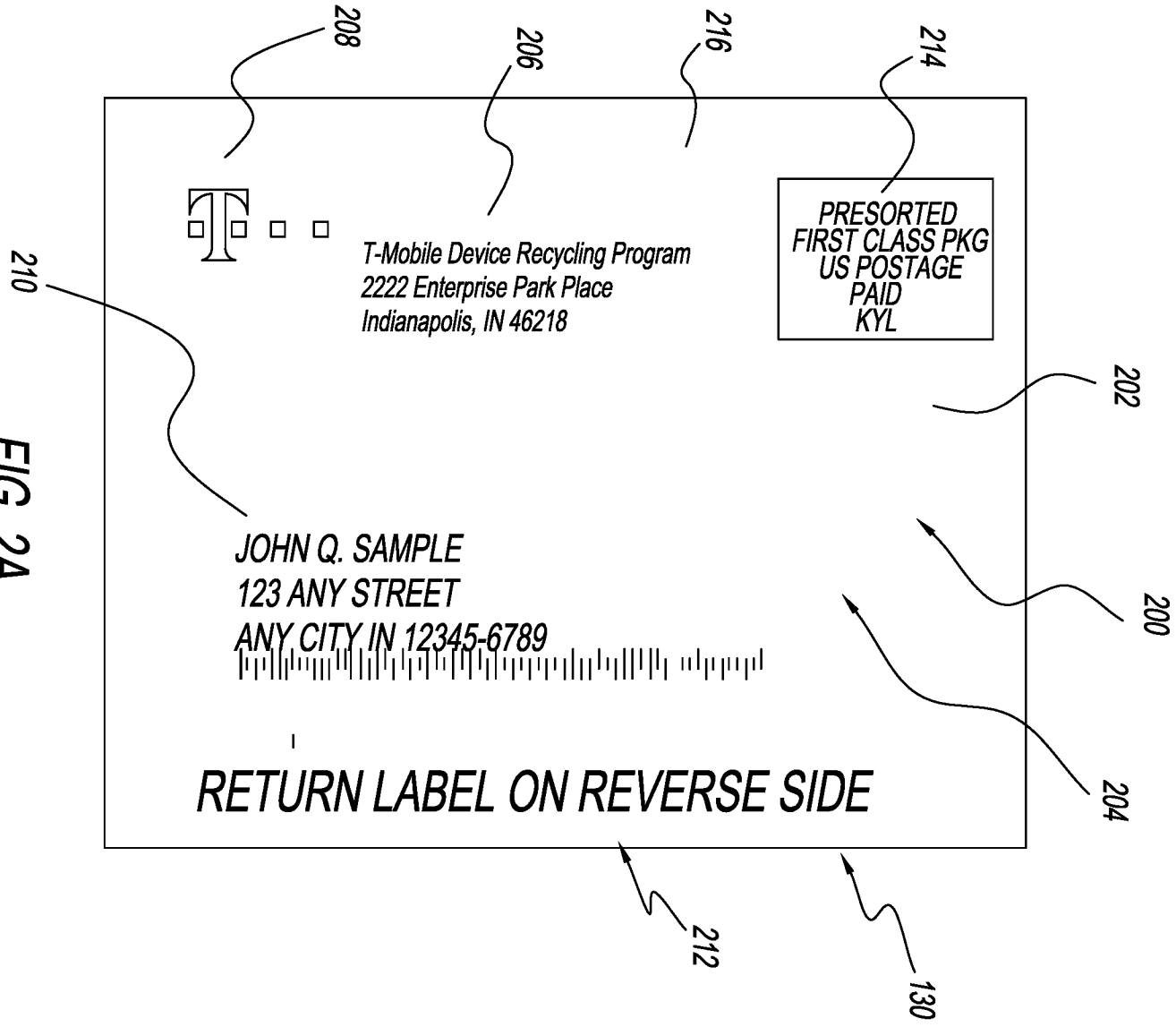
FIG. 2A depicts a top view of a combined mailing label according to a further form of the present application, having a first label portion having outbound shipment information thereon.
Figure 2B:
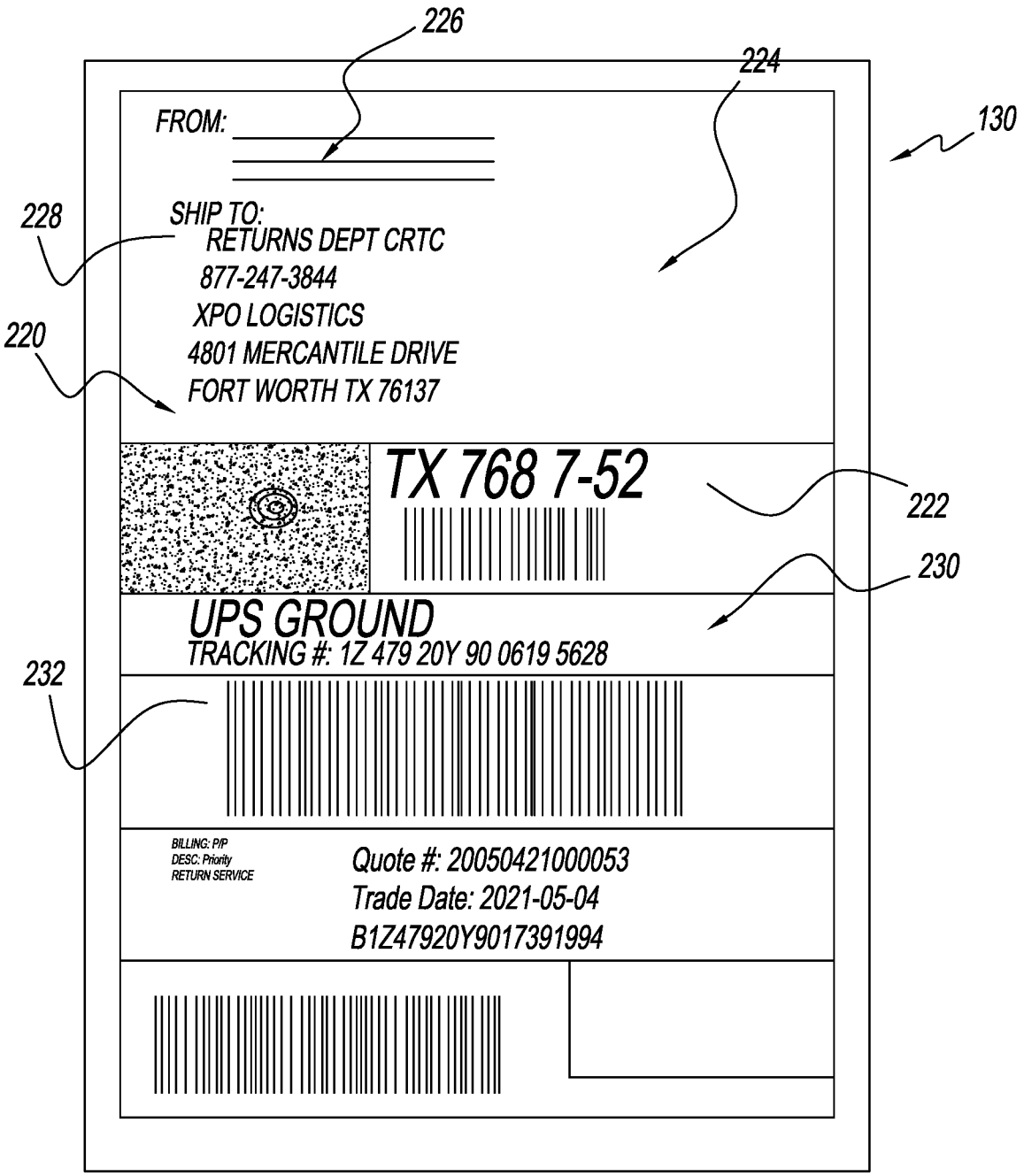
FIG. 2B depicts a bottom view of the combined mailing label of FIG. 2A and illustrates a second label portion having return shipment information thereon.
Figure 2C:
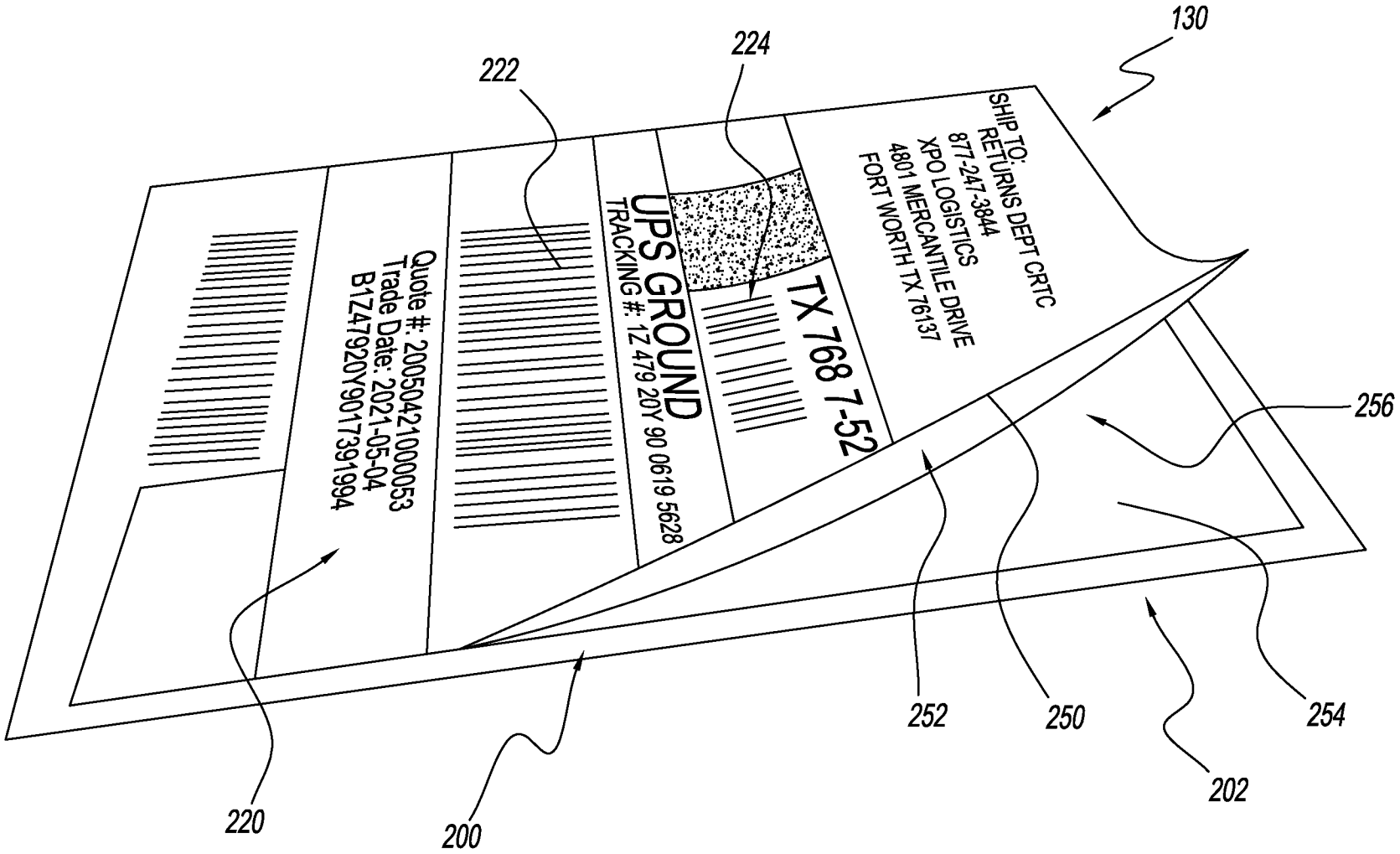
FIG. 2C depicts a side view of the combined mailing label and illustrates the second label portion being peeled from the first label portion.

Referring now to FIGS. 2A, 2B, and 2C, an exemplary combined shipping label 130 will now be described. The combined label 130 has a first side 216, which includes a first label portion 200, and a second side 232, which includes a second label portion 220. Preferably, a face surface 202 of the first label portion 200 (e.g., the outbound label) and a second face surface 222 of the second label portion 220 (e.g., the return label) are each directed outwardly in an opposing relationship. Specifically, the face surface 202 is located on the first side 216 and the second face surface 222 is located on the second side 232.

The first label portion 200 includes the face surface 202. This first label portion 200 can also be referred to as the outbound label. First shipment information 204 (e.g., outbound shipment information 204) is printed on the face surface 202. This outbound shipment information 204 can include the name and address of the first user who ships the outbound container 103 in a "from" area, the logo 208 of the first user, the name and address of the recipient in a "to" area, and shipping payment and/or postage 214.

A lower surface 254 of the first label portion 200 can include a release substrate or an easy release backing 256. This release backing 256 can be formed of silicone coated paper or of various polymers from which an adhesive 252 can easily release.

The second label portion 220 includes a second face surface 222 upon which second shipment information 224 (e.g., return shipment information 224) is printed. This return shipment information 224 can include the first recipient's name and address in a "from" area 226, the second recipient's name and address in a "to" area 228, and shipping payment and/or postage 230.

The second label portion 220 has a second lower surface 250 with an adhesive 252 located thereon. Contact between the adhesive 252 on the second label portion 220 and the easy release backing 256 on the first label portion 200 releasably adheres the second label portion 220 with the first label portion 200, forming the combined label 130. In this manner, the combined label 130 includes outbound information 204 on the first side 216 and return or inbound information 224 on the second side 232.

The first label portion 200 and the second label portion 220 can be manufactured of a stiff paper or cardboard material with sufficient strength to withstand the rigors of mail.

The pouch 132 retains the label 130 to the container body 109. As is illustrated in FIG. 2, the pouch 132 includes a viewing window 121 thorough which the face surface 202, and outbound shipping information 204 located thereon, can be easily viewed. A perimeter 119 of the pouch 132 can be adhered to the top panel 102; however, it is preferable that any adhesive utilized does not contact the face surface 202 and the second face surface 222. The viewing window 121 does not include an adhesive. The face surface 202 and the second face surface 222 are preferably free from adhesive so that the combined label 130 can easily be removed from the pouch 132. The pouch 132 covers and extends over the combined label 130. An opening tab 117 is depicted on the pouch 132 which enables the first recipient to easily tear open the pouch 132 and remove the combined label 130 therefrom.

Use of the combined label 130 will now be described in connection with FIGS. 2-2C. After receiving the container 103 from the first user, the first recipient tears open the pouch 132 by pulling on the opening tab 117. The first recipient then removes the combined label 130 from the pouch 132. The first recipient can then flip the combined label 130 so that the second face surface 222 on the second side 232 faces upwardly. The first recipient then peels the second label portion 220 from the easy release backing 256 of the first label portion 200. The first label portion 200 can then be discarded or placed inside the container 103.

The second label portion 220 is then applied to the container body 109 and is adhered to the container body 109 via the adhesive 252 located on the second lower surface 250. In this manner, the return shipment information 224 on the second face surface 222 faces outwardly from the container body 109 and can be easily read and/or scanned by a shipping carrier. After the object 1504 is placed inside the container body 109, the resealable closure flap 111 can be sealed and the container 103 can be mailed to the second recipient, who can be the first user.

Exemplary, non-limiting methods of the construction and life cycle of the container 103 will now be described in connection with FIGS. 5A-13. It is important to note that various stages and functions performed during the method are described as being performed by specific parties (e.g., cardboard manufacturer, converter, erector, filler, and shipper); however, it should be understood that the various functions and stages can be performed by one or more parties and some parties can perform more than one function.

A cardboard manufacturer forms sheets of cardboard material 105 from sheets or webs of paper. As will be known to a person of skill, corrugated cardboard 105 comes in a variety of thicknesses and sizes and is usually designated by flute size (e.g., designed as A, B, C, D, E, or F flute size).

Figure 5:
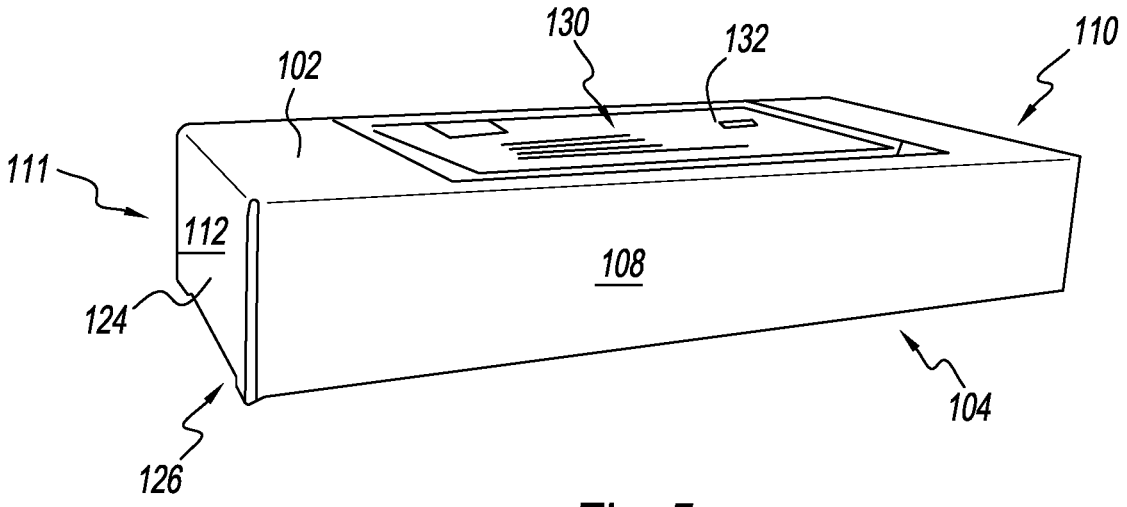
FIG. 5 depicts a perspective side view of the container.
Figure 5A:
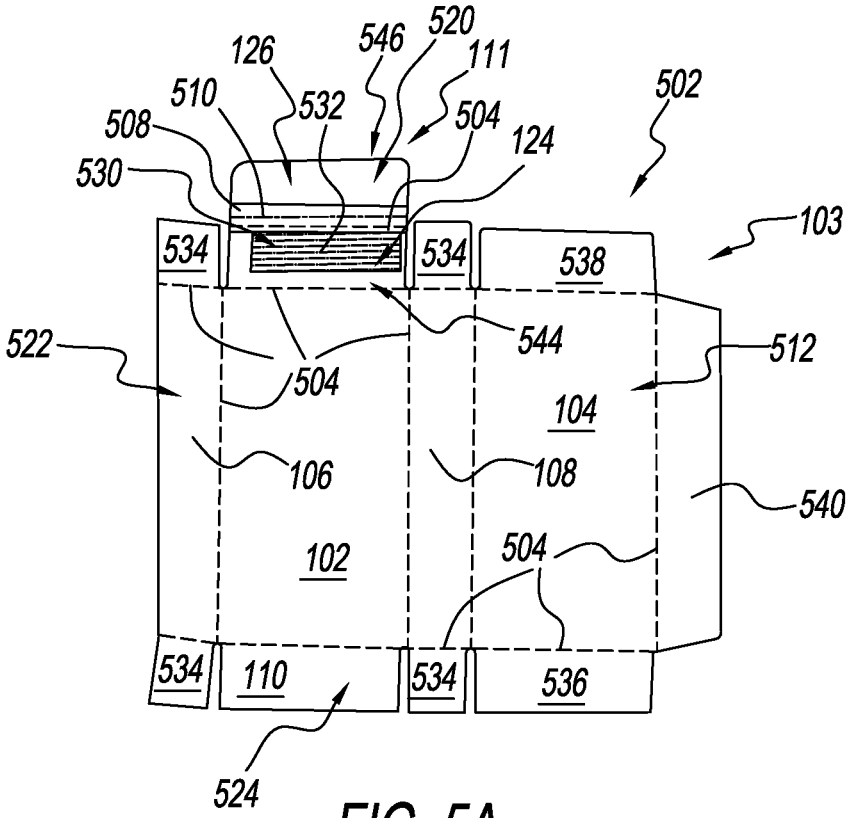
FIG. 5A depicts a bottom view of an exemplary die cutout from which the container of FIG. 1 may be formed.
Figure 5B:
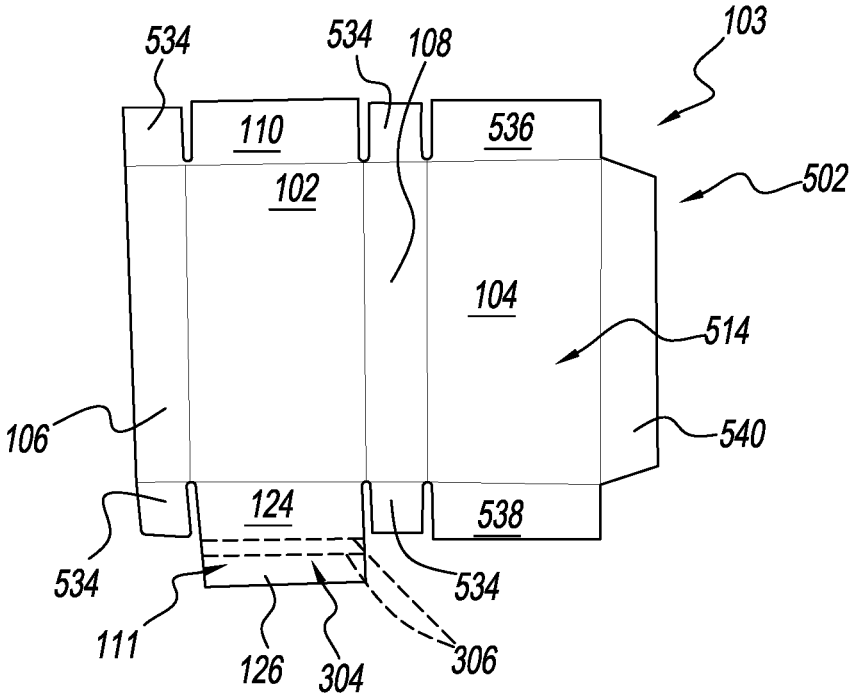
FIG. 5B depicts a top view of the exemplary die cutout.

A converter cuts the cardboard material 105 into a desired shape. The cardboard 105 can be cut with a stamping machine, utilizing a die, and is commonly referred to as die cutting. Referring now to FIGS. 5A and 5B, an exemplary die cut 502 will be described from which the container 103 can be formed. FIG. 5A depicts a lower surface 512 of the die cut 502, a portion of which will define a receiving cavity (e.g., an interior) of the container 103. FIG. 5B depicts an upper surface 514 of the die cut 502, a portion of which will define an exterior 125 of the container 103.

Preferably, the container 103 is formed of a unitary (e.g., single piece) of cardboard 105 to lesson assembly, and therefore labor, costs. The die cut 502 is a unitary structure and includes the top panel 102, the bottom panel 104, the first side panel 106, the second side panel 108, the resealable closure flap 111, and the second end panel 110. The die cut 502 can include an inner side panel 540, a first inner end panel 536, and a second inner end panel 536. The die cut 502 can also include wing panels 534.

The die cut 502 is depicted as including fold lines 504. The various panels included in the die cut are folded at fold lines 504 to form the container body 109. The fold lines 504 can be stamped into the die cut 502 for ease of folding, as is known.

The resealable closure flap 111 is part of the unitary die cut 502. A proximal end 544 of the closure flap 111 is depicted as being connected to the top panel 102 and a distal end 546 of the closure flap 111 extends outwardly from the die cut 502.

The release 302, which is depicted as pull-tab tear away strip 304, is located between the proximal segment 124 of the closure flap 111 and the distal segment 126 of the closure flap 111. When utilized to open the container 103, the pull-tab tear away strip 304 will tear the closure flap 111 along axis 510, thereby separating the proximal segment 124 from the distal segment 126 and enabling access to the interior of the container 103. A reverse side 508 of the pull-tab tear away strip 304 is shown in FIG. 5A.

The release 302 can be integrally formed into the cardboard material 105 and cut therefrom with the die cut 502; however, depending upon the release 302 selected and the desired process utilized to form the container, the release 302 can also be integrated into the closure flap 111 later in the process (e.g., such as when the second adhesive portion 530 is applied).

An adhesive receiving area 520 is located on the distal segment 126. An adhesive receiving area 522 is depicted on the side panel 106 and an adhesive receiving area 524 is depicted on the second end panel 110.

FIG. 5B depicts the die cut 502 as including second adhesive portion 530. The second adhesive portion 530 has a removable covering 532 located thereon. The second adhesive portion 530 is not utilized to sealingly close the first end 113 until the container 103 has been received and opened by the first recipient. Therefore, the removable covering 532 prevents the second adhesive portion 530 from prematurely sticking to the container 103 or to any inserts placed therein on the outbound trip to the first recipient. The second adhesive portion 530 can take the form of a peel and stick adhesive which includes a backing suitable for adherence to the proximal segment 124.

The second adhesive portion 530 was included in FIG. 5B to clearly depict the location of the second adhesive portion 530 on the container 103; however, it should be understood that the second adhesive portion 530 can be attached later in the process.

It is also contemplated that the container 103 can be configured to reseal for mailings beyond a round trip (e.g., single outbound and single return). For example, a resealable closure flap 111 can be included on the second end 115 and the first end 113. The proximal portion 124 can include two or more alternating second adhesive portions 530 and releases 302.

Figure 6:
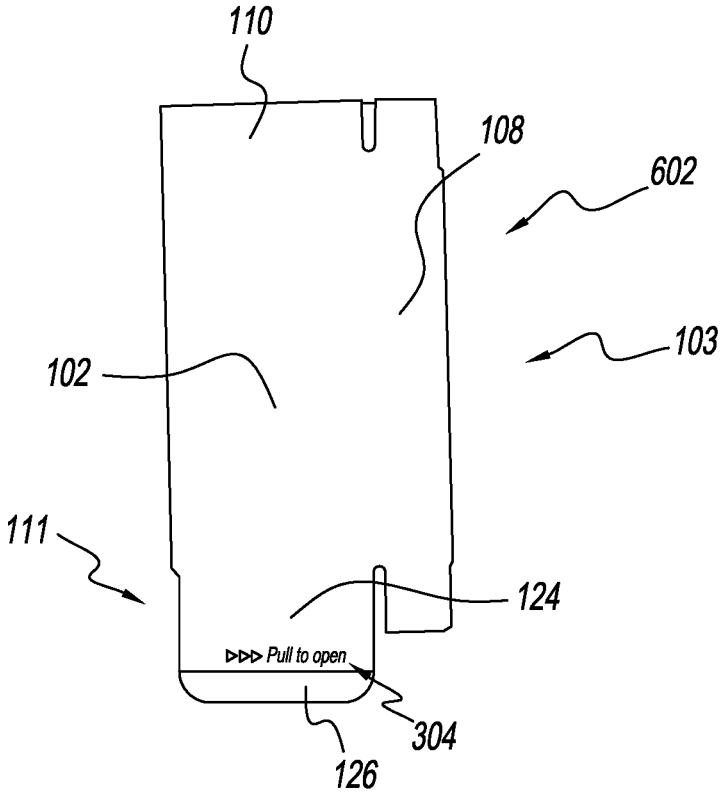
FIG. 6 depicts a top view of an exemplary container flat, which can be formed from the die cutout of FIG. 5A.
Figure 7:
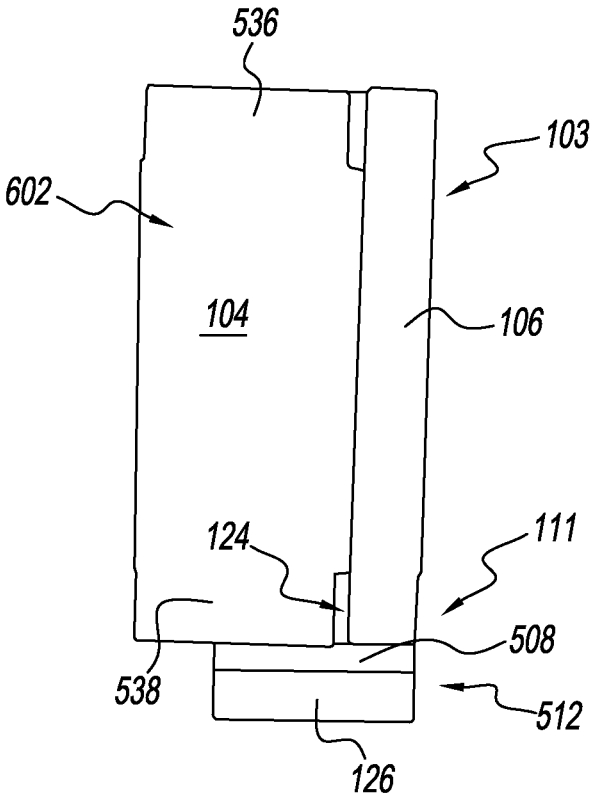
FIG. 7 depicts a bottom view of the container flat of FIG. 6.
Figure 8:
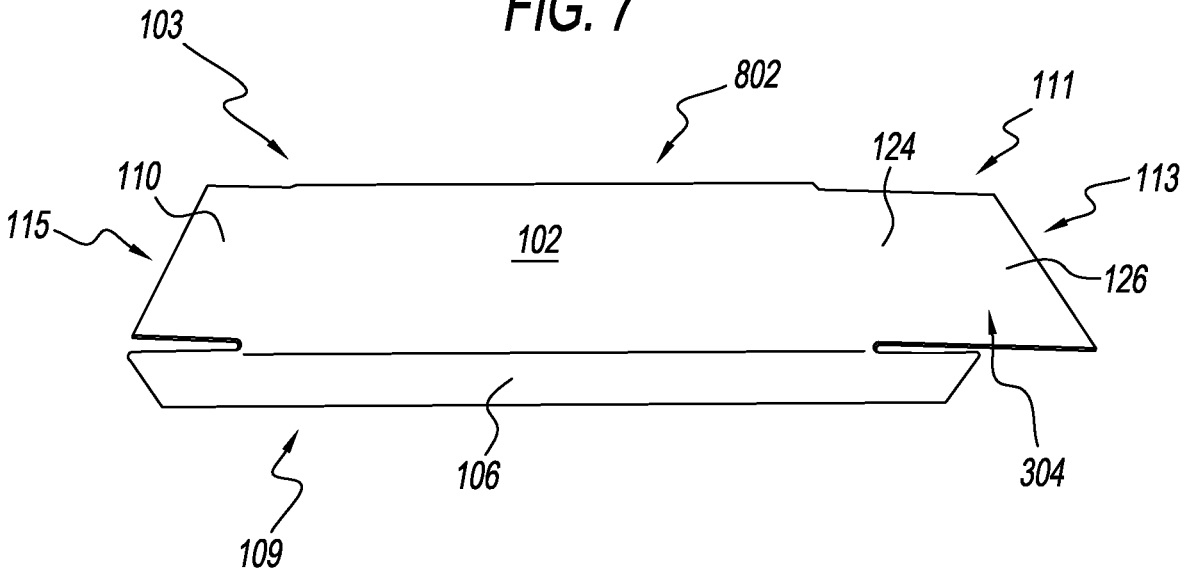
FIG. 8 depicts a side perspective view of the container flat of FIG. 5 which has been formed into a three-dimensional container body.
Figure 9:
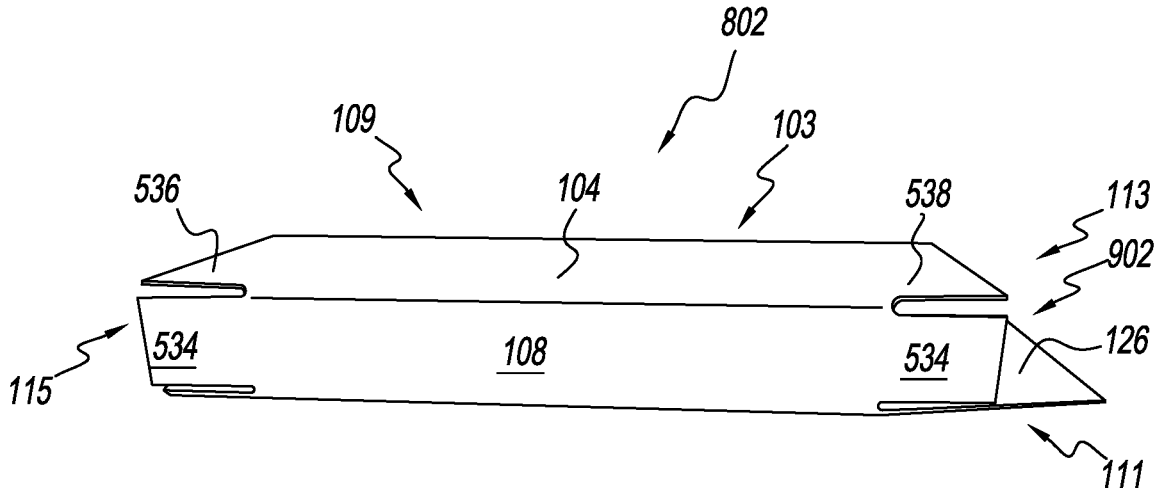
FIG. 9 is a side view of the three-dimensional container body of FIG. 8.
Figure 10:
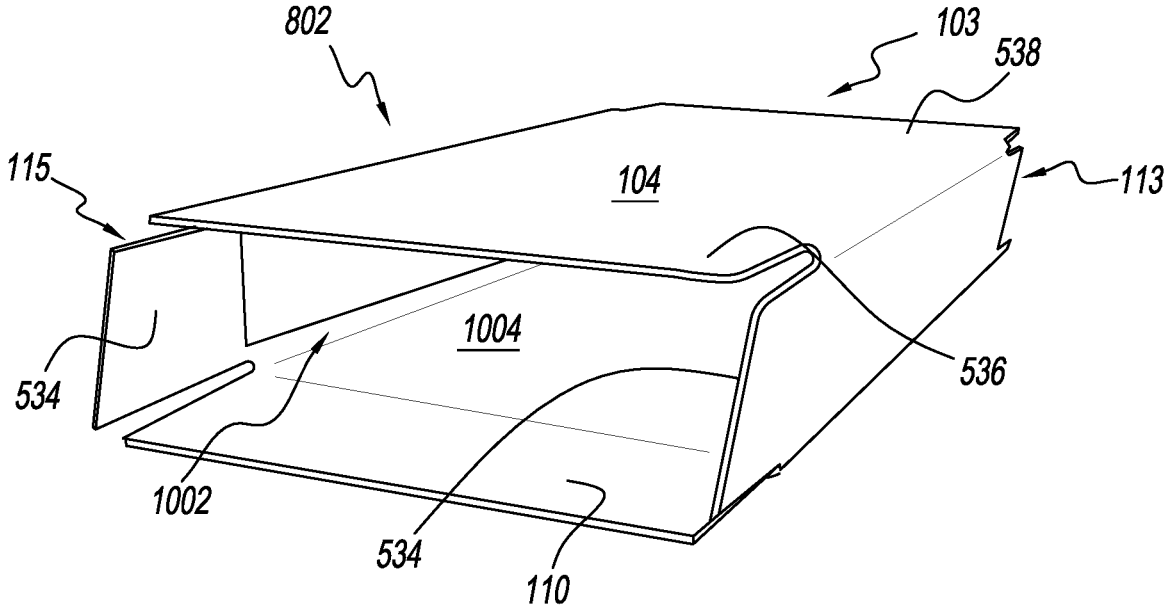
FIG. 10 depicts a perspective view of the second end of the three-dimensional container body.
Figure 11:
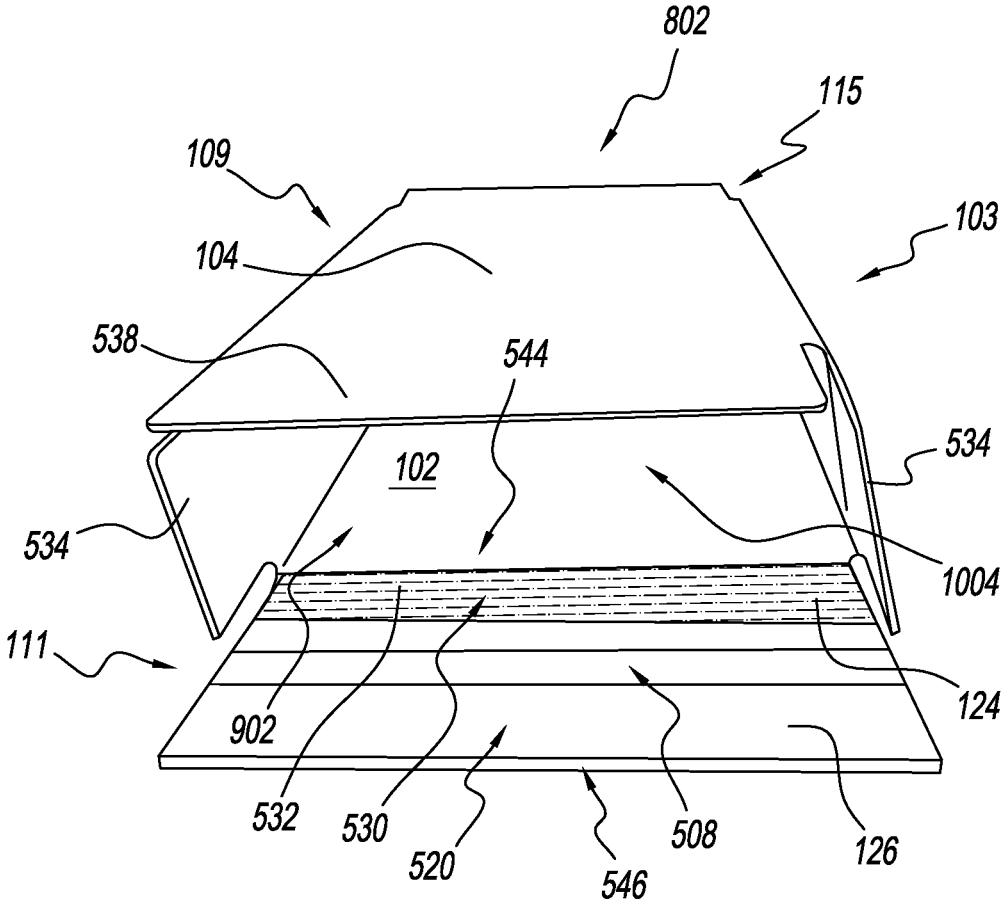
FIG. 11 depicts a perspective view of the first end of the three-dimensional container body, illustrating the resealable closure flap.

To form a container flat 602, as is depicted in FIG. 6, the converter can also fold the die cut 502 at the fold line 504 between the second side panel 108 and the bottom panel 104 and can fold the die cut 502 between the first side panel 106 and the top panel 102. The converter may apply an adhesive on the adhesive receiving area 522 and adhere the first side panel 106 to the inner side panel 540. FIGS. 6 and 7 depict an exemplary container flat 602.

As utilized herein, the term "adhesive" is intended to include a wide variety of adhering substances, which include but are not limited to glues, epoxies, various polymer based adhesives and adhesive strips, and other sticky substances and adhesives as would be known to a person of skill.

The container flat 602 is not yet formed into container 103. However, as the container flat 602 has not yet been fully constructed (e.g., is flattened) the container flat 602 requires much less shipping space than the fully constructed container 103. This container flat 602 is then shipped to and erector. The erector will be described herein as serving the roles of an erector, filler, and shipper as it is believed that the integration of these operations frequently occurs.

The erector receives the container flat 602 and forms the container flat 602 into a three-dimensional container body 802, shown in FIGS. 8-11. One primary difference between the container 103 in the closed outbound configuration 107 and the container 103 formed into the three-dimensional container body 802, is that in the three-dimensional container body 802 the container 103 has the first end 113 in an open configuration and the second end 115 in an open configuration.

The erector orients the container flat 602 into this three-dimensional container body 802 that has an internal receiving cavity 1004. To achieve this, the erector orients the first side panel 106 and the second side panel 108 to be approximately perpendicular relative to the top panel 102 and the bottom panel 104 (e.g., the first side panel 106 and the second side panel 108 are placed in a substantially parallel orientation, and the first side panel 106 and the second side panel 108 intersect the top panel 102 and the bottom panel 104 at an angle of around 90 degrees.

Serving in the role of a filler, the erector places one or more inserts 1202 through the opening 1002 in the second end 115 and/or the opening in the first end 113.

Referring now to FIGS. 10-13, the insert 1202 can include various padding members, such as a padded pouch 1206 (e.g., which can be a padded envelope as are known), a dual padded insert 1302, or other padding. The insert 1202 can also include instructions 1204 for the first recipient to trade-in or return the object 1504, and/or various other literature such as advertising materials.

Preferably, the insert 1202 is constructed in a manner to permit the insert 1202 to be placed in the receiving cavity 1004 of the container 103 mechanically. For example, the insert 1202 can travel on a first conveyor belt and the three-dimensional container body 802 can travel on a second conveyor belt next to the first conveyor belt. The three-dimensional container body 802 can be oriented on the second conveyor belt such that the open first end 113 or the open second end 115 is oriented toward the insert 1202 on the first conveyor belt. A machine, such as a robotic arm, pneumatic cylinder, or various other electro-mechanical devices, can push the insert 1202 from the first conveyor belt through the first end 113 or second end 115 and into the receiving cavity 1004.

Figure 13:
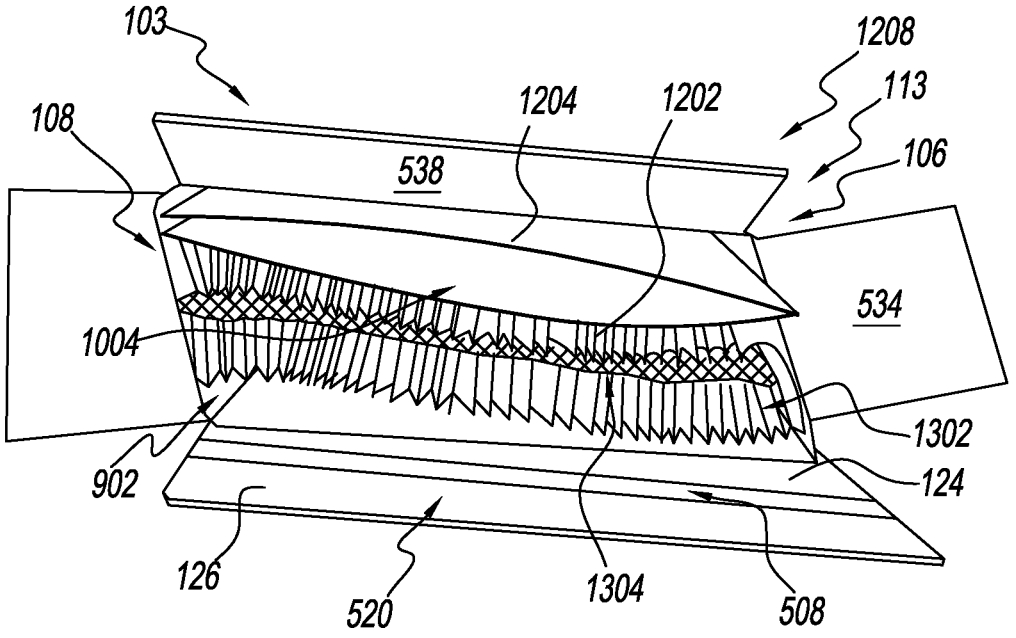
FIG. 13 depicts an end view of the container body of FIG. 8, which has been placed in an alternative packed for outbound configuration that includes a dual padded insert.
Figure 14:
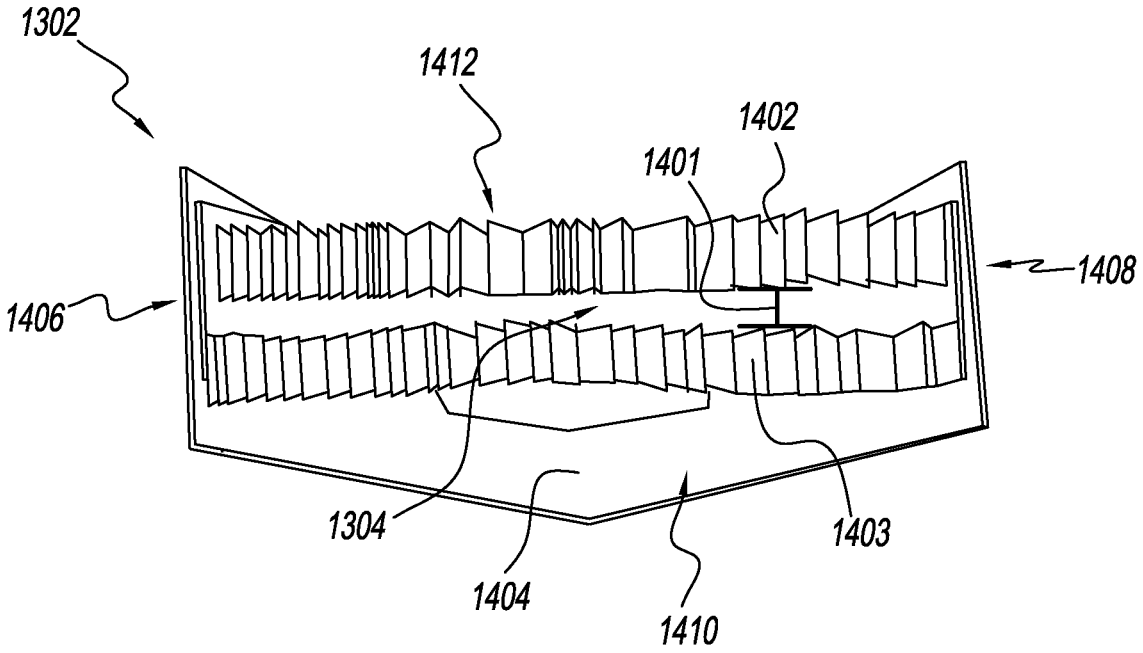
FIG. 14 is an end view of the dual padded insert of FIG. 13.
Figure 15:
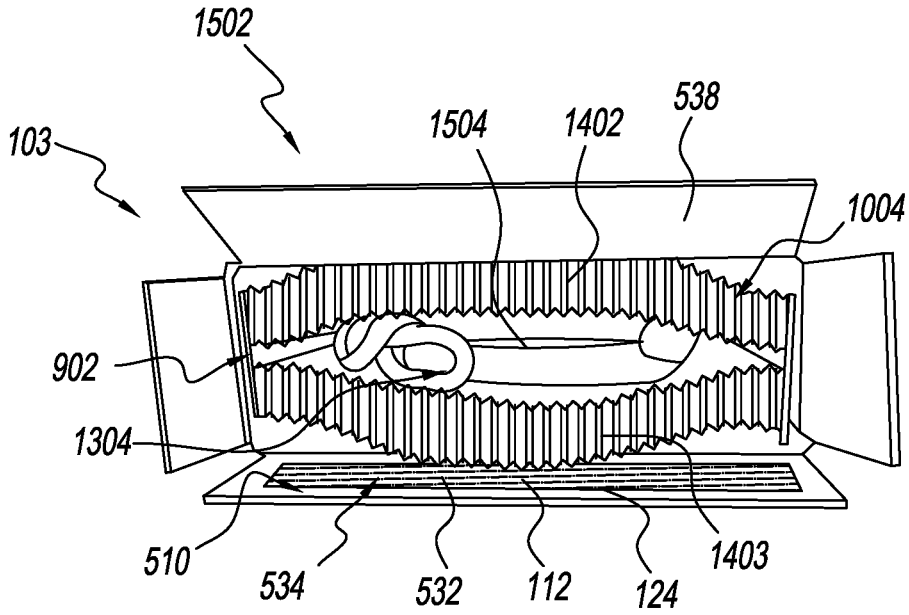
FIG. 15 depicts an end view of the container of FIG. 13 as packed in a return configuration.

Referring briefly to FIGS. 13-14, an exemplary dual padded insert 1302 will now be described. This dual padded insert 1302 includes a first padding member 1402 and a second padding member 1403. Opposing walls 1406, 1408 extend upwardly from a base member 1404. The base member 1404 and walls 1406, 1408 can be constructed of a cardboard or cardstock-type material 1410.

The first padding member 1402 and the second padding member 1403 extend between the walls 1406, 1408 and have a substantially parallel relationship. A space 1402 can be provided between the padding members 1402, 1403. Opposing ends of the first padding member 1402 and the second padding member 1403 can be adhered and/or mechanically fastened to the walls 1406, 1408. A pocket 1304 is located between the padding members 1402, 1403 or the padding members 1402, 1403 can compress to provide for the pocket 1304. The pocket 1304 is configured to receive the object 1504 from the first recipient.

The padding members 1402, 1403 are structured to provide cushion to the object 1504 when the container 103 is mailed in a return configuration. Such cushion can be very important when the object 1504 is easily breakable (e.g., as is the case with smartphones and many other small electronic devices).

The padding members 1402, 1403 are depicted as having a pleated 1412 accordian-type shape. However, it is contemplated that various padding members 1402, 1403 can be utilized in the dual padded insert 1302 including foams, inflated plastics such as bubble wrap, rubber padding materials, and other cushioning members as are known.

Advantageously, this dual padded insert 1302 can be readily mechanically inserted into the receiving cavity 1004. This ease of mechanical insertion is believed to result from the base member 1404 providing for ease of sliding, and the interaction between the walls 1406, 1408 and padding members 1402, 1403 maintains the overall dimensions of the insert 1302 (e.g., so that the insert 1302 will not compress and expand as the machine begins to push the insert 1302).

Figure 12:
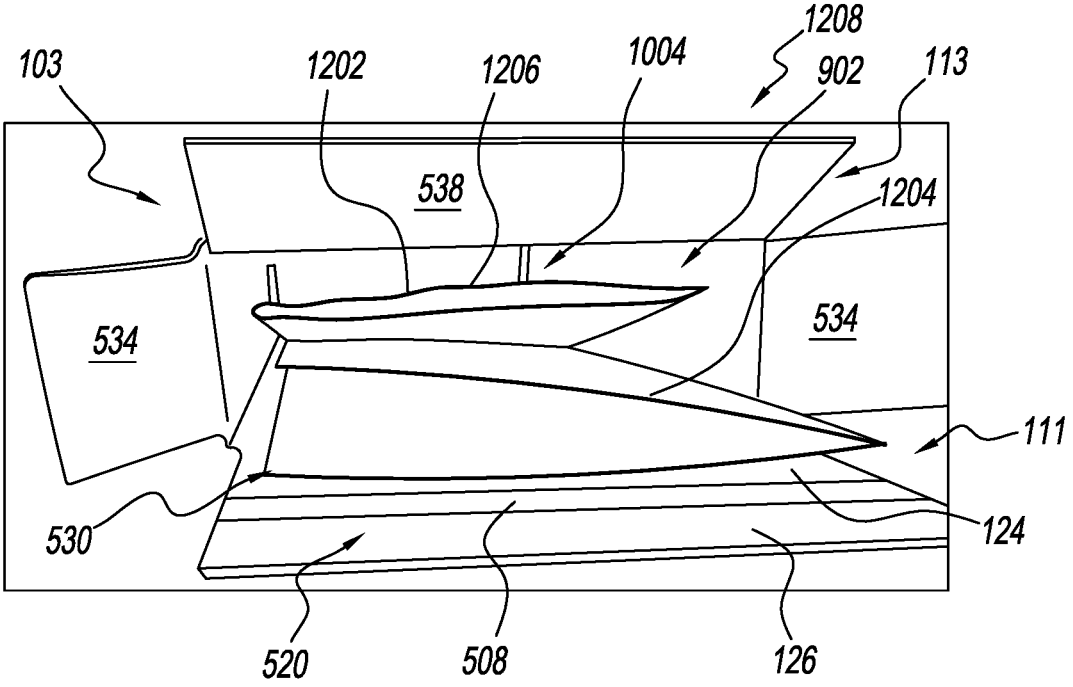
FIG. 12 depicts an end view of the container body of FIG. 8, placed in an exemplary packed for outbound configuration that includes a padded pouch insert.

When the inserts 1202 have been placed into the receiving cavity 1004, the container 103 is now in a packed for outbound configuration 1208, as shown in FIGS. 12 and 13. To achieve the closed outbound configuration 107, the ends 113, 115 of the container 103 should be closed and the label 130 should be applied.

Referring back to FIGS. 1-2 and 5A-5B, the erector then closes the first end 113 and the second end 115 to close the container 103. To close the first end 113, adhesive is applied to the adhesive receiving area 520 located on the distal segment 126 of the closure flap 111. It is important to note that the adhesive receiving area 520 is distinct from the second adhesive portion 530, and the second adhesive portion 530 is not utilized to achieve the closed outbound configuration 107.

The erector then folds the wing panels 534 at the first end 113 and the first inner flap panel 538 toward the opening 902. The closure flap 111 is folded at fold lines 504 so that the proximal end of the closure flap 111 covers the opening 902 to serve as the first end panel 112. The distal segment 126 of the closure flap 111, and the adhesive thereon, is pressed against the bottom panel 104 such that the adhesive on the adhesive receiving area 520 adheres the distal segment 126 to the bottom panel 104.

To close the second end 115, adhesive is placed on the adhesive receiving area 524 of the second end panel 110. The erector folds the wing panels 534 at the second end 115 and the second inner end panel 536 toward the opening 1002. The second end panel 110 is then pressed against the second inner end panel 536 so that the adhesive on the adhesive receiving area 524 adheres the second end panel 110 to the second inner end panel 536 yielding a closed packed configuration, as will later be described as closed and packed container 2606 in FIG. 27.

Although specific adhesive receiving areas 520, 522, 524 have been described, adhesives can be applied to the opposing surface with equal effect (e.g., rather than placing adhesive on the second end panel 110 to adhere the second end panel 110 to the second inner end panel 536, adhesive can be applied to the second inner end panel 536 to adhere the second end panel 110 thereto).

The erector can then serve in the role of a shipper and can print the outbound shipping information 204 and return shipment information 224 onto the label 130, which can be a combined label 130. The combined label 130 includes a first side 216 having a first face 202 which includes outbound shipping information 204 and a second side 232 which includes a second face surface 222 that has return shipment information 224 located thereon.

As will be understood, the specific outbound shipping information 204 and return shipment information 224 will depends upon the person and/or entity who is the first user, the person and/or entity who will be the first recipient, and the person and/or entity who will be the second recipient. As a non-limiting example, in the case of a container 103 configured for a smartphone, the user who sends the container 103 in a closed outbound configuration 107 can be the phone carrier (e.g., Sprint, T-Mobile, Verizon, AT&T, etc.) the manufacturer (e.g., Apple, Samsung, Google, etc.); however, the user can also be a third-party distributor, servicer, or logistics fulfillment company who handles the returns and/or servicing for the manufacturer or carrier.

The first recipient that receives the container 103 in the closed outbound configuration 107 will likely be a consumer or end user who desires to return, trade-in, or have service work performed on the smartphone. The first recipient mails the container 103 in a return mail configuration.

The second recipient of the container 103, who receives the container in return configuration can be the first user or a third-party that handles such inbound returned objects 1504 for the manufacturer, distributor, or carrier.

After the label 130 is printed, the erector who is serving as a shipper, can place the label 130 on the container 103 with the outbound shipment information 204 directed outwardly from the container. The label 130 can be held to the container 103 with one or two small drops of adhesive to prevent the label 130 from sliding or blowing off the container 103 as the container 103 moves along a conveyor; however, the amount and type of adhesive used should be such that that the label 130 can be easily removed from the container 103 without tearing.

A perimeter 119 of the pouch 132 is then adhered around the label 130. The container is now in the closed outbound configuration 107 as has been described herein. The erector can then deposit the container in the mail.

When the first recipient receives the container 103 the first recipient will open the container 103. This can be accomplished by tearing the pull-tab tear away strip 304. Removal of the pull-tab tear away strip 304, as has been described herein, results in a separation of the proximal segment 124 of the closure flap 111 from the the distal segment 126. The distal segment 126 will remain adhered to the bottom panel 104. As the proximal end 544 of the closure flap 111 is foldably connected to the top panel, the proximal segment 124 can move away from the distal segment 126 adhered on the bottom panel 104.

The first recipient can gain access to the receiving cavity 1004 by folding the proximal segment 124 (e.g., being first end panel 112), the first inner end panel 538, and the wing panels 534 outwardly and away from the opening 902. With the panels 112, 538, and 534 moved away from the opening 902, first recipient may then access the receiving cavity 1004 and remove any instructions 1204 therefrom.

Figure 16:
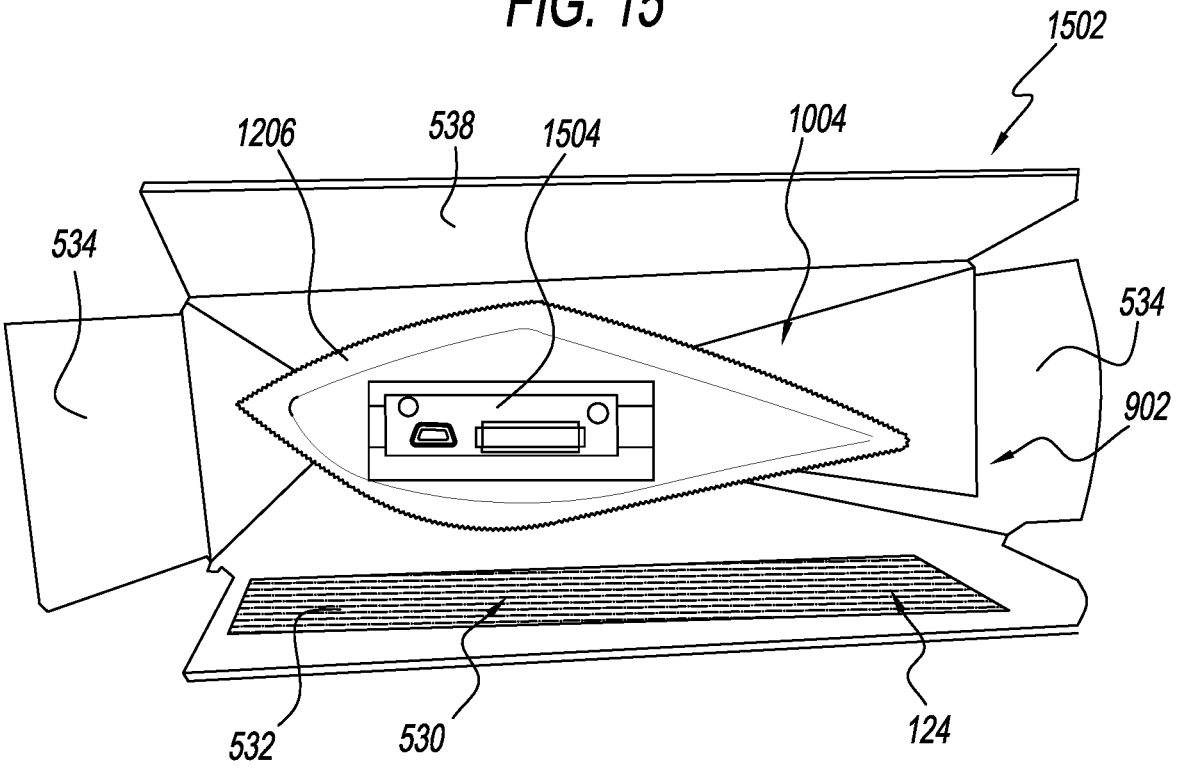
FIG. 16 depicts an end view of the container of FIG. 12 as packed in a return configuration.
Figure 17:
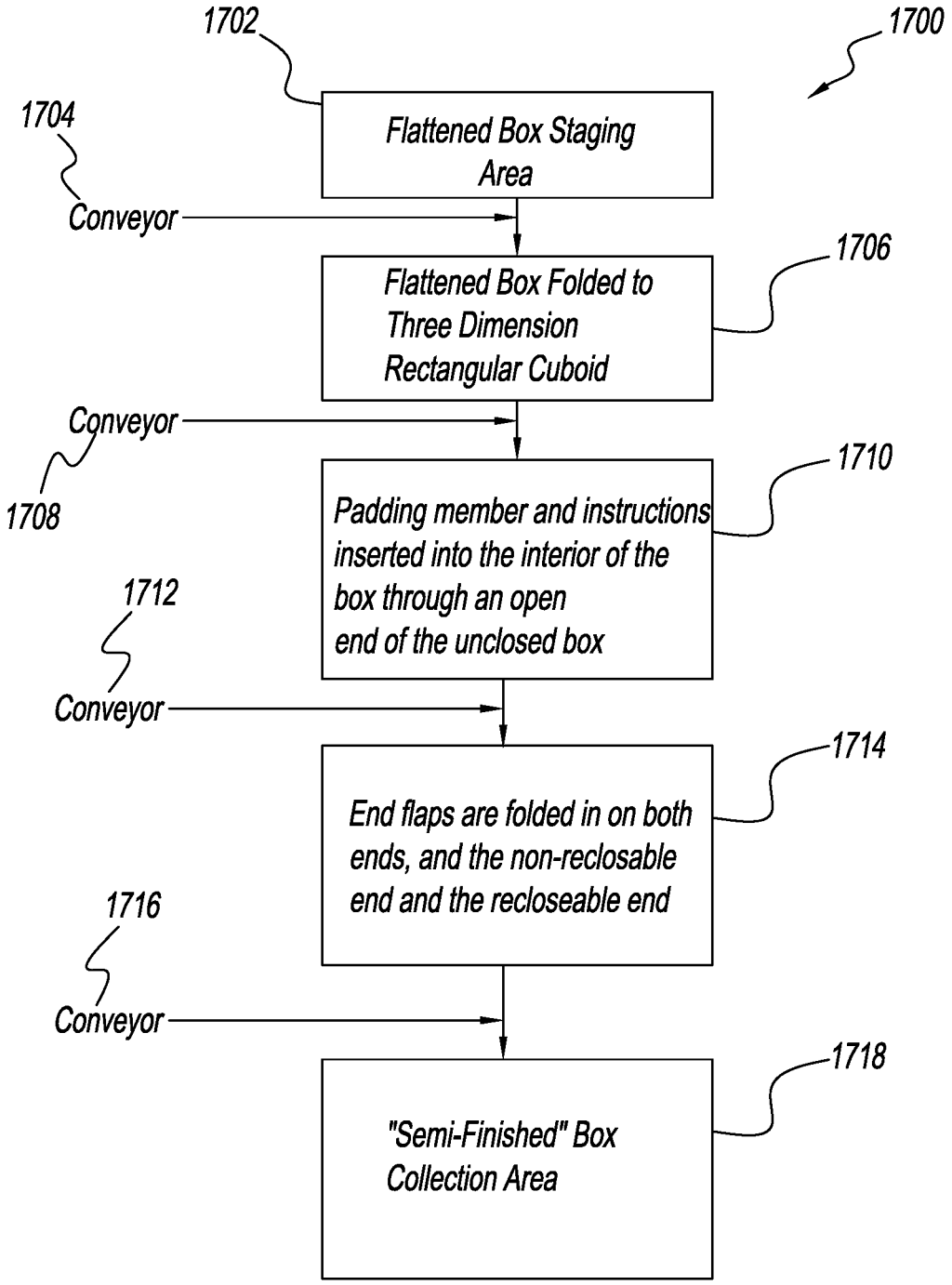
FIG. 17 is a schematic view of an exemplary EFG assembly device according to a first form of the present invention.

The first recipient can then place the object 1504 to be mailed, presently taking the form of smartphone 1504 in this method, to be mailed in the receiving cavity 1004. Depending upon the instructions 1204 and any inserts 1202 which are provided in the outbound container 107, the first recipient may place the smartphone 1504 directly into the receiving cavity 1004, within a padded pouch 1206 to be located within the receiving cavity 1004 (as shown in FIG. 16), into the pocket 1304 of a dual padded insert 1302 between the first padding member 1402 and the second padding member 1403 (as shown in FIG. 17), or with other padding or inserts which are provided.

The first recipient can open the pouch 132, by pulling opening tab 117. The combined label 130 can be pulled from the pouch, separating from any small glue droplets which adhered the combined label 130 to the container 103 during manufacture. The first recipient can now peel the second label portion 220 from the first label portion 200 and can adhere the second label portion 220 to the exterior 125 of the container 103. The container 103 is now in a packed for return configuration 1502. The first end 113 of the container 103 can be closed and the container 103 shipped.

The first end 113 of the container 103 is sealed closed utilizing the second adhesive portion 530 on the proximal segment 124 of the resealable closure flap 111. The first recipient can fold wing panels 534 and the first inner end panel 538 inwardly toward the opening 902. The first recipient can remove the covering 532 from the second adhesive portion 530 and can press the proximal segment 124 toward and against the inner end panel 538. With the proximal segment 124 pressed against the inner end panel 538, the adhesive of the second adhesive portion 530 will adhere the proximal segment 124 to the inner end panel 538 closing and sealing the first end 113.

With the second label portion 220 adhered to the container 103, the smartphone 1504 inserted into the receiving cavity 1004, and with the first end 113 adhered closed, the container 103 is in a ready for return mail configuration. The first recipient can now place the container 103 in the mail to be delivered to the second recipient.

The second recipient receives the container 103, opens the container 103, and removes the object 1504. The container 103 can be discarded.

An exemplary method of manufacturing the container 103, and machinery utilized to construct the container 103 will now be described. The container 103 can be constructed through a process which is highly automated and mechanized, reducing labor costs. One benefit of the round trip container 103 is that it is capable of being inventoried in as a closed and packed container 2606 (e.g., depicted in FIGS. 25A and 27, in which inserts 1202 have been placed in the receiving cavity 1004 and where the ends 113, 115 of the container 103 are closed and sealed; however, the label 130 has not been applied). Prior art round trip containers could not be inventoried in a closed and packed configuration as the return label would need to be placed within the container prior to closing and sealing the container.

In this manner, the container 103 when inventoried as a closed and packed container 2606 can quickly be transitioned to the fully closed outbound configuration 107 by printing and applying the combined label 130 and the pouch 132 to the exterior of the container 125. The ability to readily produce on demand round trip containers 103 in a fully closed outbound configuration 107 is believed to be highly advantageous as the demand for such can vary widely from day to day and week to week.

For example, the introduction of a highly desirable new product, such as a new Apple iPhone release, will typically result in an initial surge of sales. This initial surge of sales can bring a surge of phones to be returned (e.g., as part of a trade-in program). Additionally, carriers such as Verizon, T-Mobile, AT&T, etc. can run deals on products, which can result in an increased demand for round trip containers 103 through trade-in offers or phone buy-out returns. For example, some carrier offers have provided a deeply discounted smartphone in return for extending the customer's contract with the carrier or switching the customer's business from one carrier to another. Demand for containers 103 can also surge due to manufacturer recalls or consumers becoming aware of a given issue with a smartphone (e.g., battery life issues).

An exemplary process performed by an erector/filler/gluer assembly ("EFG Assembly") will now be described. FIG. 17 is a schematic representation of the steps that occur during the process performed by the EFG Assembly. It is contemplated that some steps of the process 1700 are manually performed by humans; however, most steps within process 1700 are preferably automated and mechanized.

Referring now to FIGS. 17018, the step 1702 depicts that the container flats 602 are placed staging area 1702. The container flats 602 are conveyed 1704 to a flat box feeder assembly 1804. At step 1706 the container flat 602 is folded by a folder assembly 1804 to form a three-dimensional container body 802 having a substantially rectangular-cuboid shape 101. The three-dimensional container body 802 is conveyed 1708 to a filler assembly 1808. The ends 113 and 115 are depicted in an open configuration on the three-dimensional container body 802.

At step 1710, the filler assembly 1808 places any inserts 1202, such as dual padded insert 1302, padded pouch 1206, and/or instructions 1204 through an open end 113 or end 115 and into the receiving cavity 1004 of the container 103.

The container 103, with the insert 1202 located therein, is then conveyed 1712 to a gluer assembly 1810.

At step 1714, the gluer assembly 1810 folds the wing panels 534 at the first end 113 and the first inner flap panel 538 toward the opening 902. The wing panels 534 at the second end 115 and the second inner end panel 536 are folded toward the opening 1002, which can be performed by the gluer assembly 1810 at the same time as the folding of the panels of the first end 113. The closure flap 111 is folded.

The gluer assembly 1810 adheres the distal segment 126 of the closure flap 111 to the bottom panel 104. The second end panel 110 is adhered by the gluer assembly 1810 with the second inner end panel 536. A closed and packed container 2606 has now been formed.

The closed and packed container 2606, which is a semi-finished mailing container 103 that merely fails to include label 130 on an exterior thereof, is then conveyed 1716 to a box collection area. At step 1718, the closed and packed containers 2606 can be either manually or automatically stacked. The closed and packed containers 2606 can remain in inventory, be forwarded to a warehouse, or sent directly to a labeling line 2600 as will be described in connection with FIGS. 26-38.

The conveying and/or conveyors 1704, 1708, 1712, and 1716 can be performed by a singular conveyor belt or multiple conveyor belt assemblies configured to move the container 103, at various stages of construction, through the EFG assembly 1800.

Referring now to FIGS. 18-25 B, the machinery of the EFG Assembly 1800 will now be described. This EFG Assembly 1800, also known as a cartoner, includes a flat box feeder assembly 1802, a folder assembly, a folder assembly 1808, a gluer assembly 1810, an insert conveyor 1806, and a box conveyor 1811 which is located next to and parallel to the insert conveyor 1806.

Figure 21:
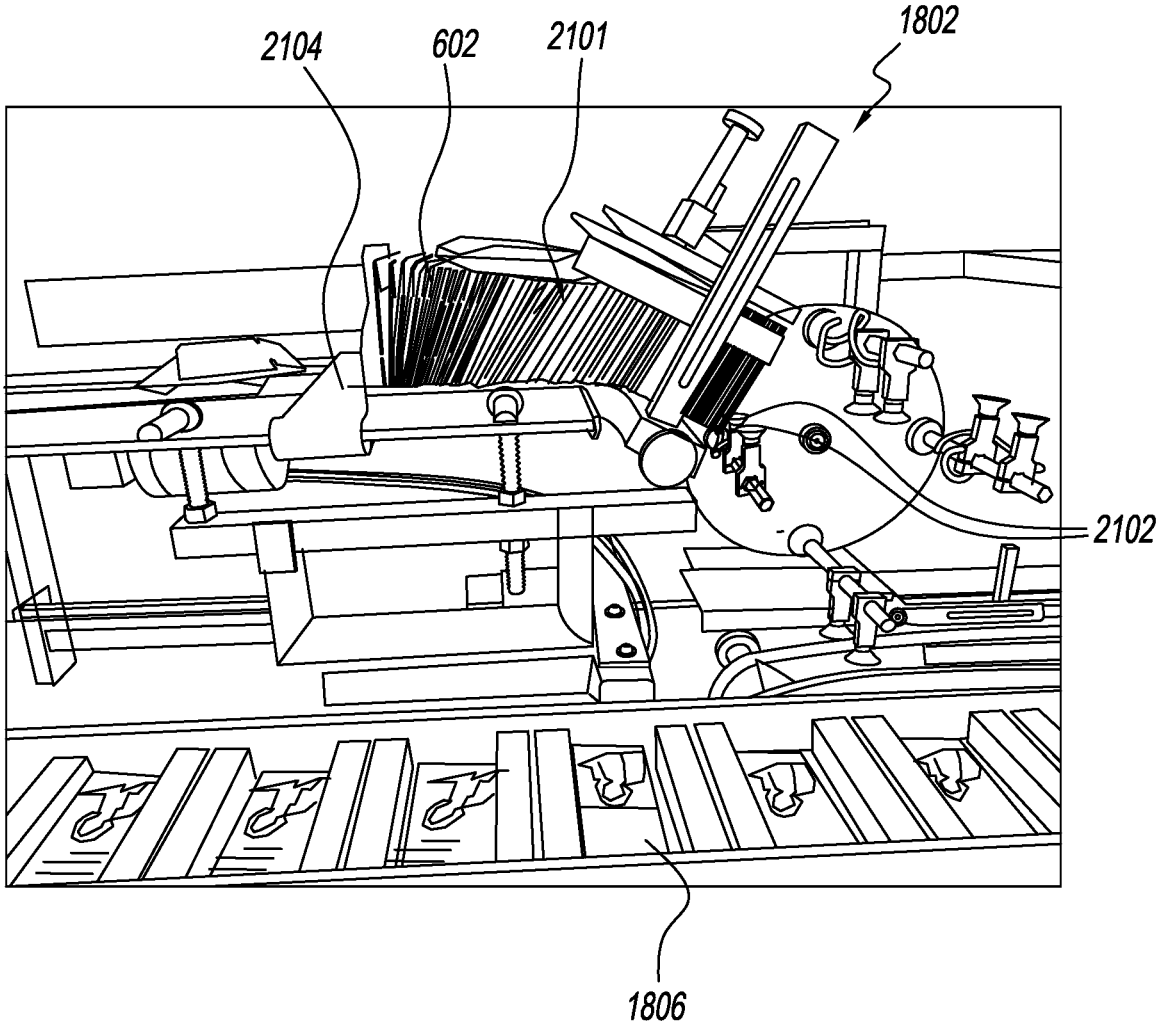
FIG. 21 depicts a side view of the flat box feeder assembly and insert conveyor of FIG. 19.
Figure 22:
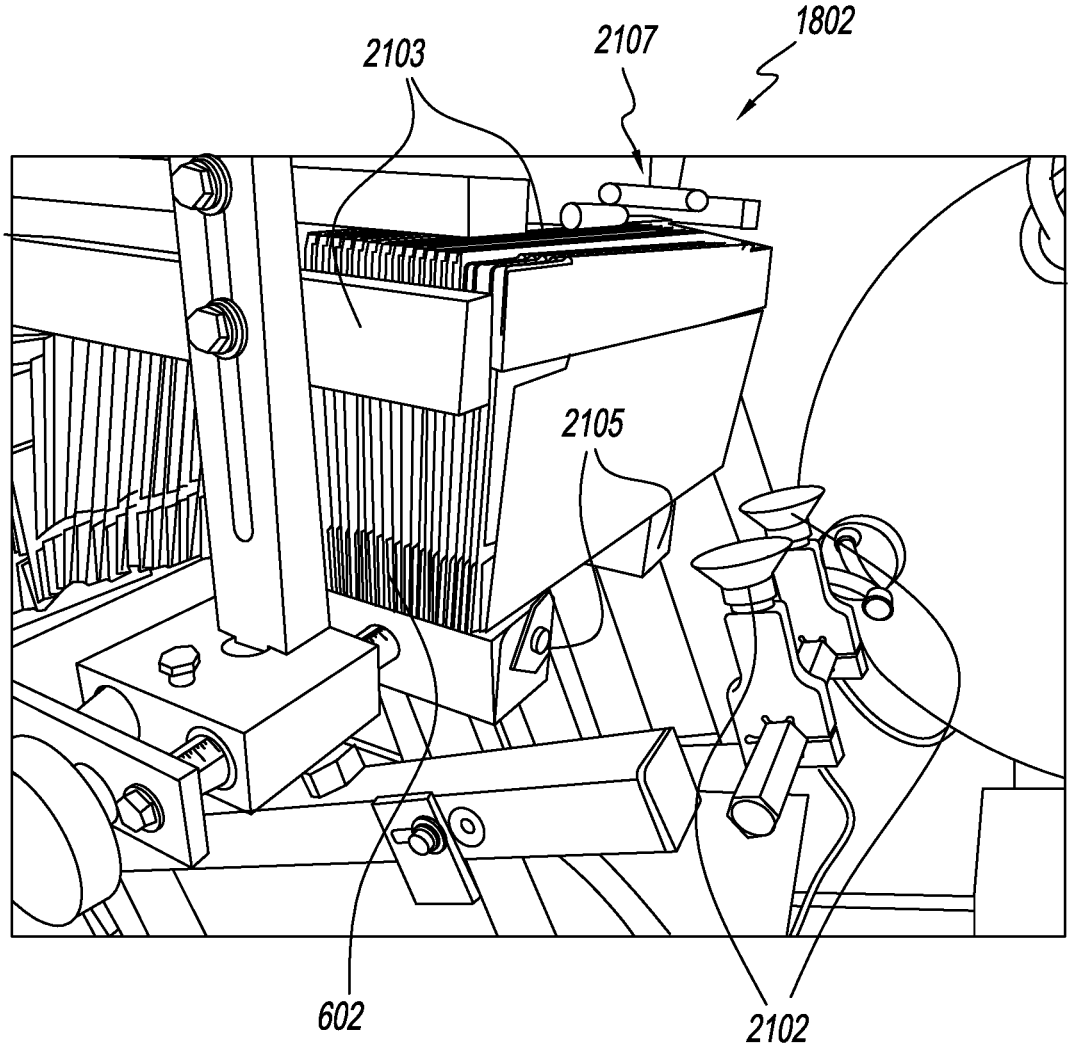
FIG. 22 is enlarged perspective view of a forward, output end, of the flat box feeder assembly.

A stack of container flats 602, depicted as array 2101, is provided to the flat box feeder assembly 1802. As shown in FIGS. 21 and 22, the flat box feeder assembly 1802 includes a rear pusher 2104, opposing aligner bars 2103, forward stops 2105, a feed mechanism 2107, and a box manipulator 2102.

The rear pusher 2104 presses against the array 2102 to enable container flats 602 to be continuously and consistently provided to the feed mechanism 2107. As the container flats 602 are pushed toward the feed mechanism 2107, the container flats 602 are oriented on their side, as the array 2101, between the opposing aligner bars 2103. The forward-most container flat 602 (e.g., the container flat 602 to be acted on by the feed mechanism 2107 next) contacts forward stops 2105.

The feed mechanism 2107, which is depicted as a mechanized push feed 2107, serves to feed individual container flats 602 (e.g., one at a time) to the box manipulator 2102 and prevents multiple container flats 602 from being simultaneously released to the box manipulator 2102. The box manipulator 2102 can take the form of rotatable suction cups 2102, which utilize a vacuum to grab the container flat 602. The rotatable suction cups 2102 then rotate the container flat 602 to be placed on the box conveyor 1811 in the desired orientation.

Figure 23:
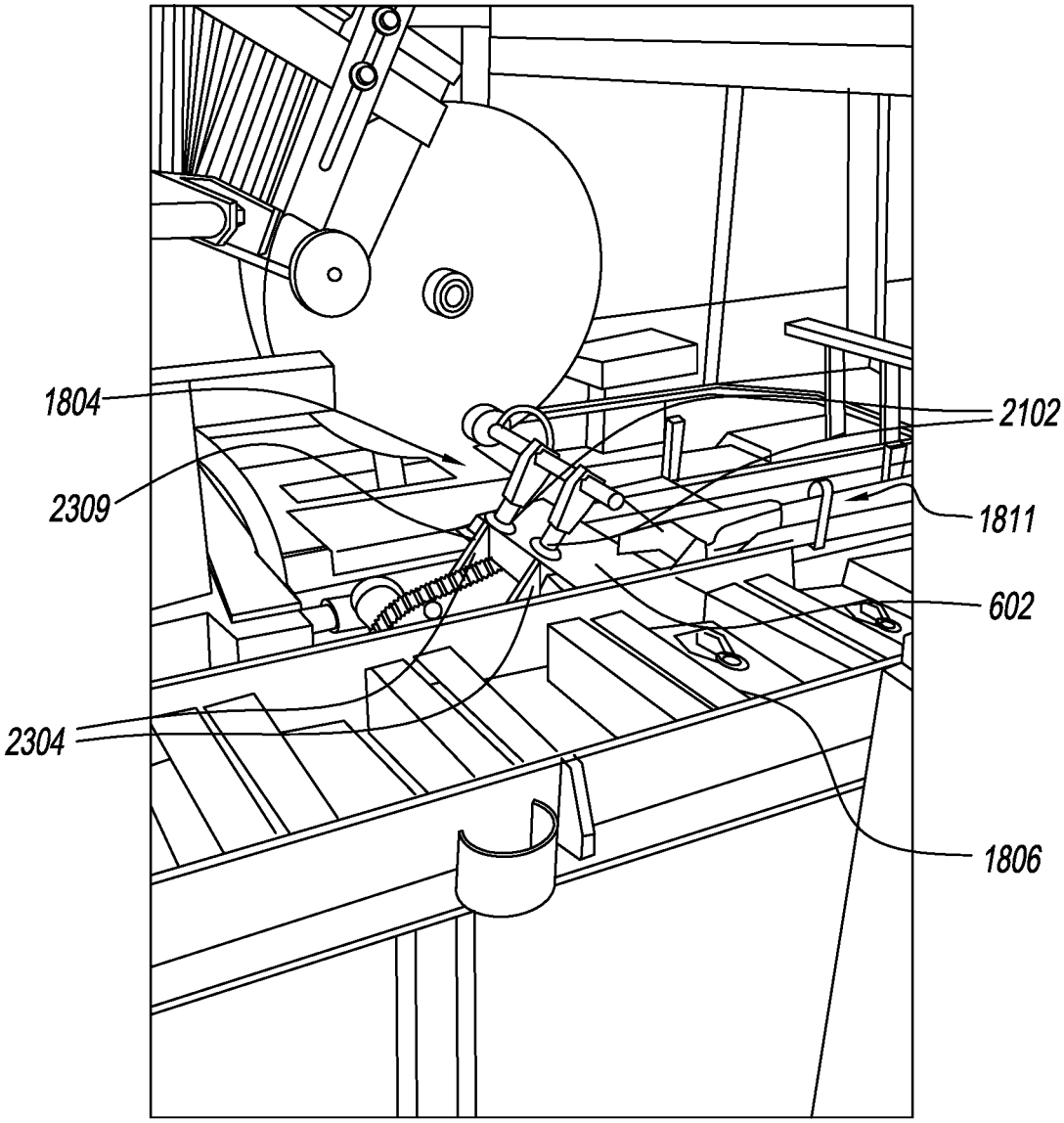
FIG. 23 is a side view of an exemplary folder assembly of the EFG assembly.

A folder assembly 1804 then folds the container flats 602 to form a three-dimensional container body 802 having a substantially rectangular-cuboid shape 101. Referring now to FIG. 23, moving stops 2304 can interact with the first side panel 106 and suction cups 2102 can interact with the bottom panel 104 (depicted as located upwardly) to orient the side panels 106, 108 vertically (e.g., with the side panels 106, 108 perpendicular to the top panel 102 and bottom panel 104).

Alternatively, the moving stops 2304, which include a vertically extending member 2309, can interact with the first side panel 106 and opposing fixed stops (not shown) can interact with the second side panel 108. Pressing the vertically extending member 2309 against side panel 106 and pressing an opposing vertically extending member of the opposing fixed stops (not shown) against the second side panel 108 will also form the container flat 602 into the three-dimensional container body 802.

As has been previously discussed, the ends 113 and 115 are depicted in an open configuration on the three-dimensional container body 802 formed by the folder assembly 1804. The three-dimensional container body 802 is conveyed by the box conveyor 1811 to a filler assembly 1808.

Figure 18:
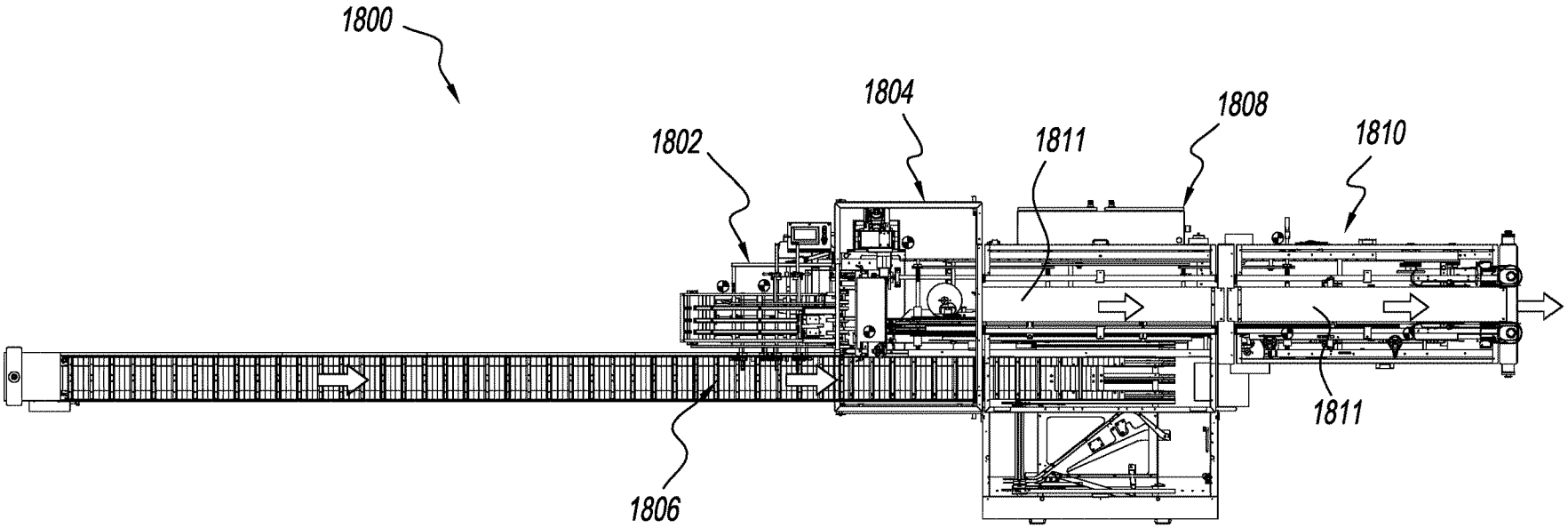
FIG. 18 depicts a blueprint plan view of the EFG assembly device.
Figure 19:
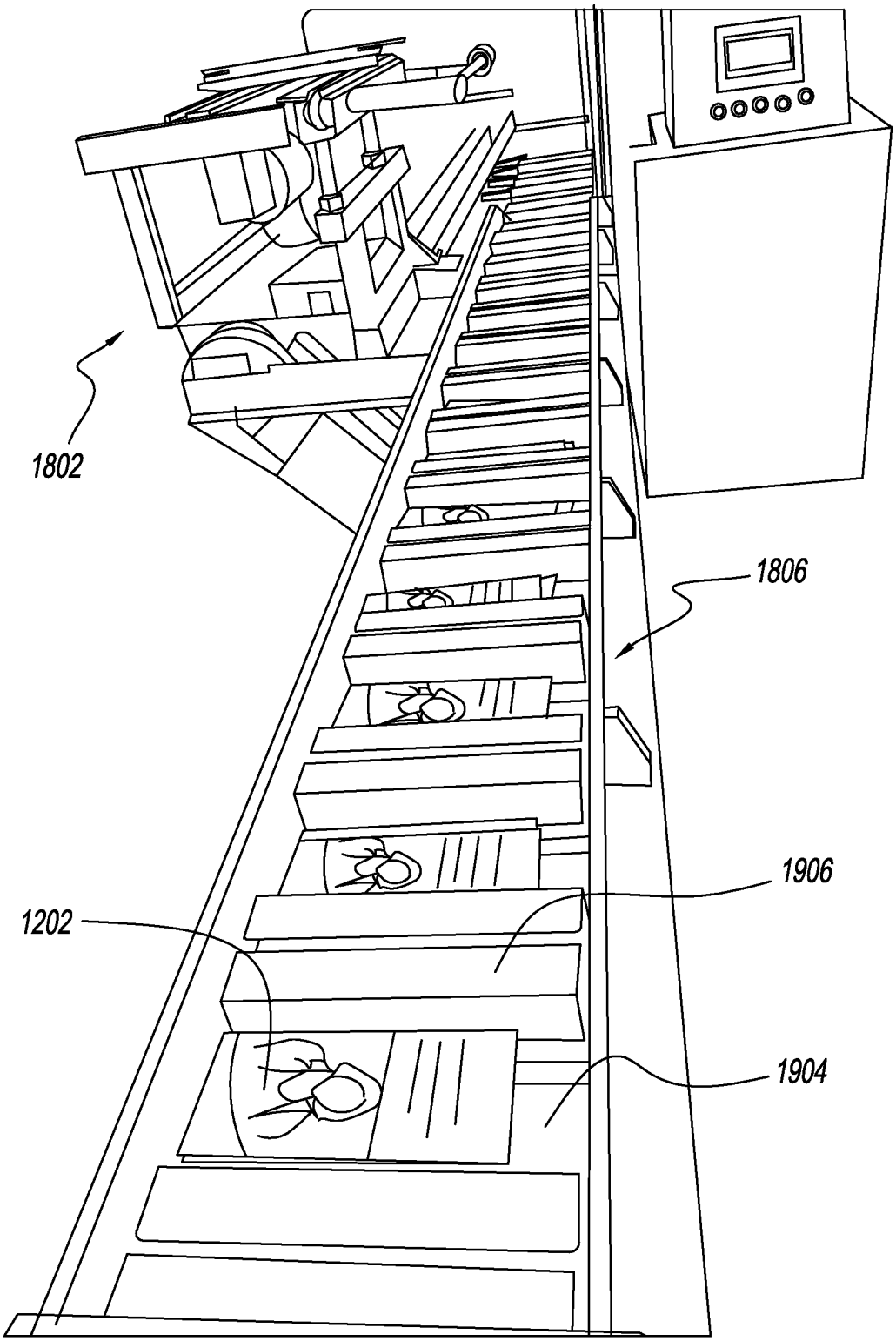
FIG. 19 depicts an exemplary insert conveyor and exemplary flat box feeder assembly of the EFG assembly of FIG. 18.
Figure 20:
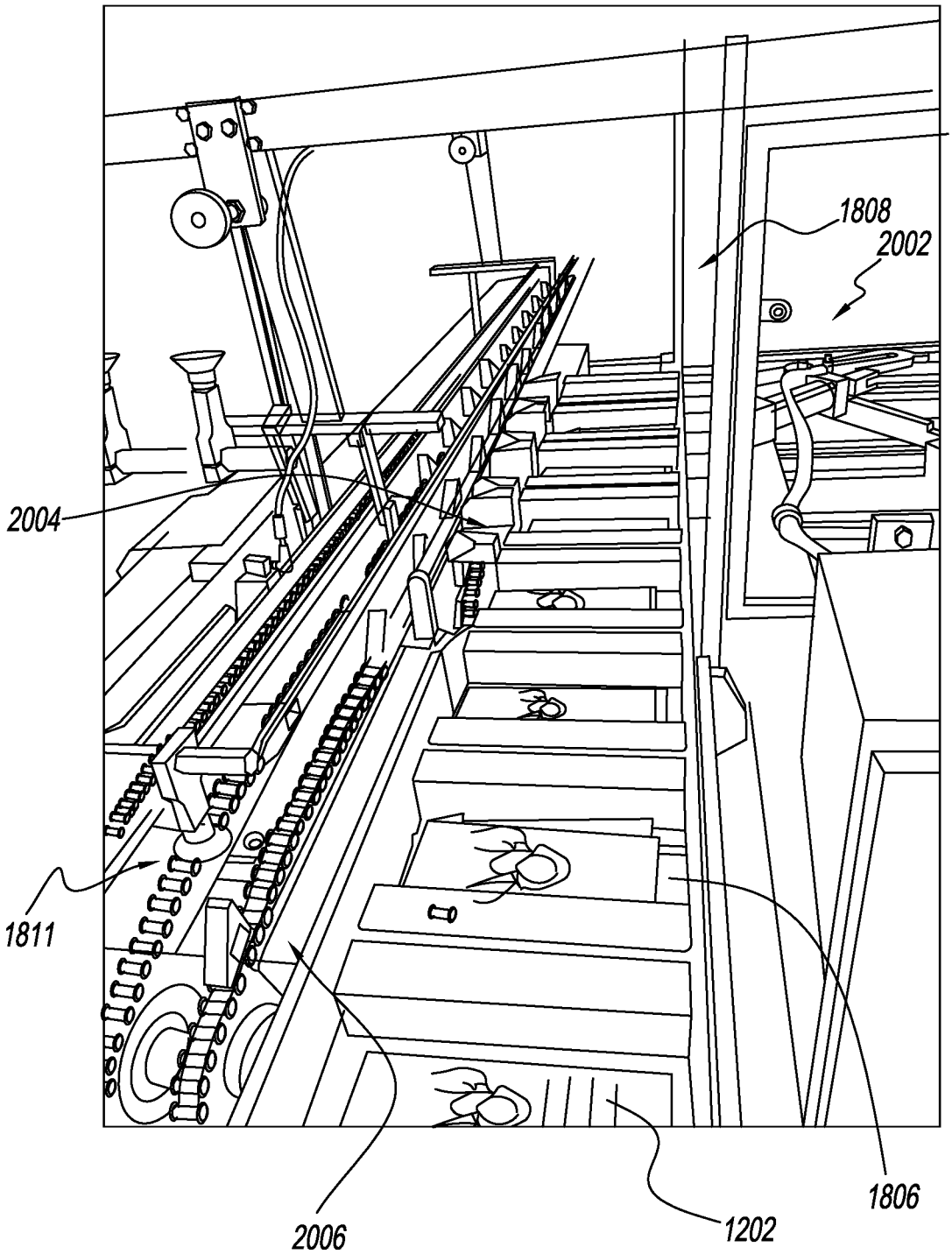
FIG. 20 depicts an exemplary filler assembly having an automated inserter which pushes inserts through an open end and into the three-dimensional container body.

Referring now to FIGS. 18-20 an insert conveyor 1806 is located next to and parallel with the box conveyor 1811. The box conveyor 1811 is depicted as being a chain drive conveyor 2006; however, it is contemplated that the conveyors described herein, including box conveyor 1811 and insert conveyor 1806, can include a number of conveyor belt types and drive types (e.g., belt, track, chain and pusher, and the like) as are known.

The insert conveyor 1806 includes a plurality of insert holding trays 1904 which are separated by spacers 1906. Inserts 1202 are placed in the insert holding trays 1904. An automatic insert feeder system (not shown) can be provided to feed the inserts 1202 into the holding trays 1904 without human intervention. As has been described, the inserts can take the form of dual padded insert 1302, padded pouch 1206, instructions 1204, other padding members, and/or literature including advertisements.

The insert conveyor 1806 transports the inserts 1202 toward the filler assembly 1808. The filler assembly 1808 transfers the inserts 1202 from the insert conveyor 1806 into the three-dimensional container bodies 802 on the box conveyor 1811. The filler assembly 1808 is constructed to operate absent human intervention.

Figure 24:
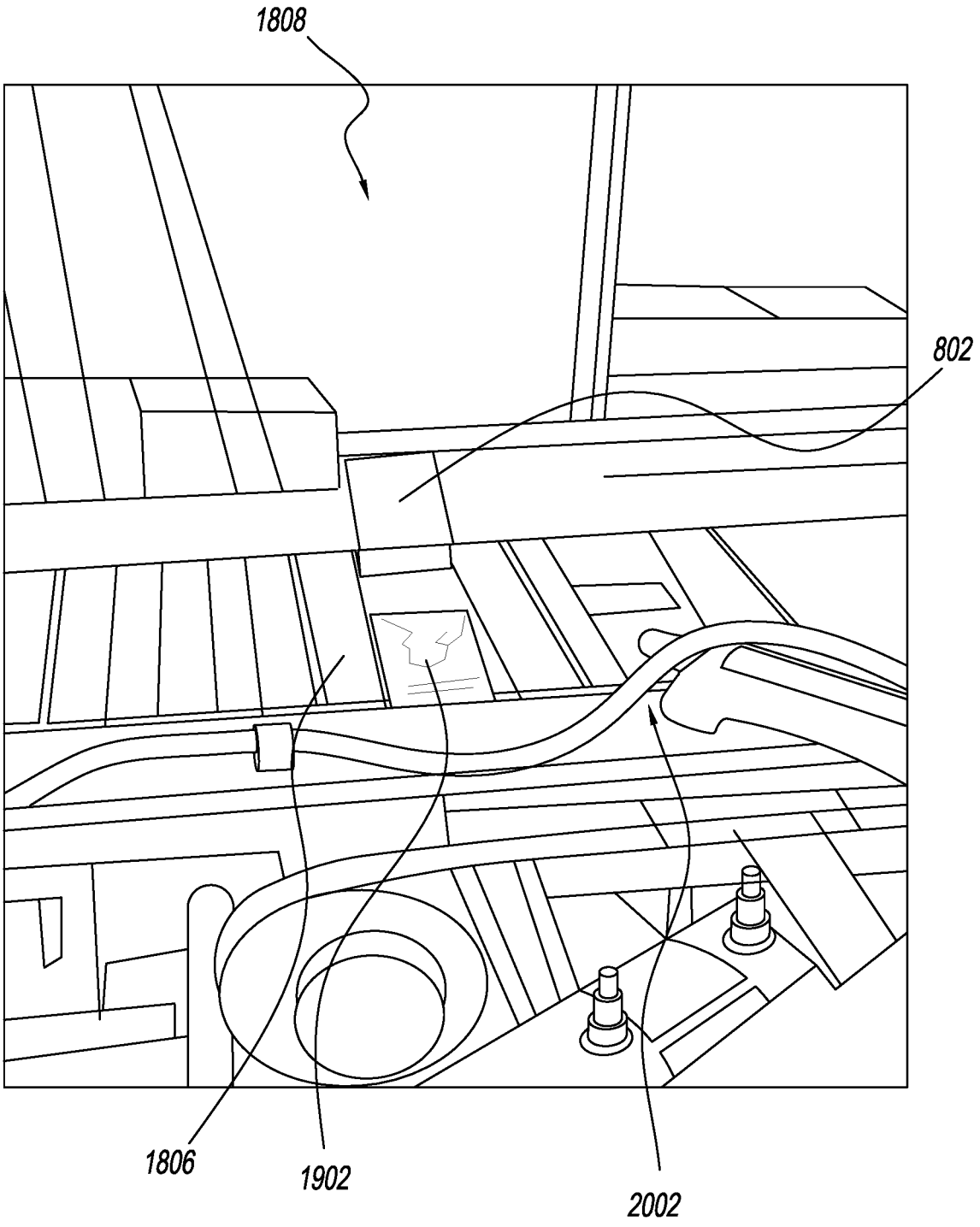
FIG. 24 is a side perspective view of the filler assembly of FIG. 20, depicting automated ram arms pushing the inserts through the open end of the container and into the container.
Figure 25:
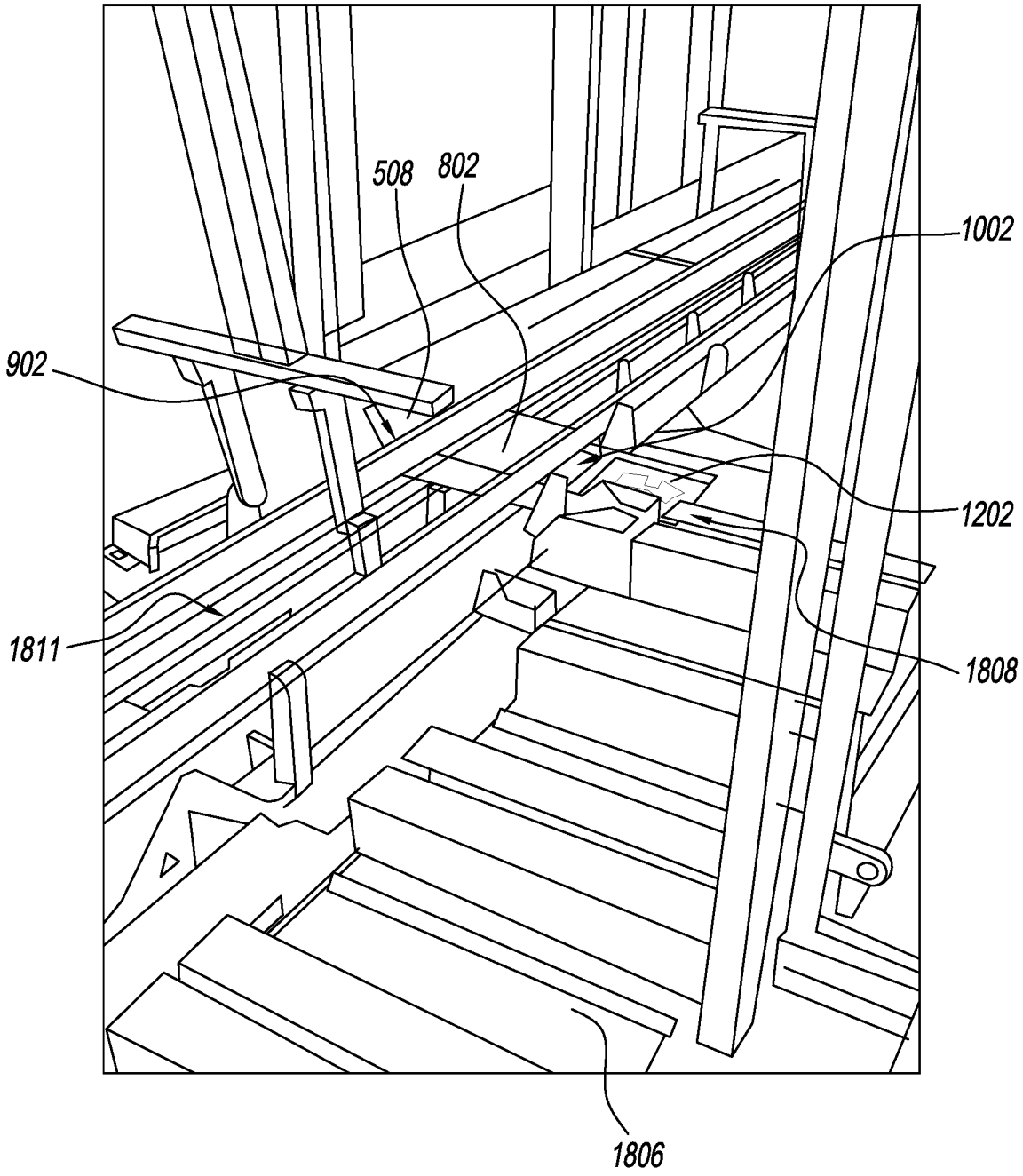
FIG. 25 depicts a perspective view of the filler assembly, depicting an insert being pushed through a tapered chute and into the container.

Referring now to FIGS. 20, and 24-25 the filler assembly 1808 converts the three-dimensional container body 802 into a packed for outbound configuration 1208. The filler assembly 1808 includes an automated inserter 2002.

Tapered chutes 2004 can be located between the insert conveyor 1806 and the box conveyor 1811. The tapered chutes 2004 are depicted as tapering inwardly toward the box conveyor 1811. When the insert 1202 is pushed through a tapered chute 2004, the tapered chute 2004 correctly aligns the insert 1202 with the opening 1002 of the open second end 115 of the container 103. It is believed that chutes 2004 will reduce the likelihood that the insert 1202 will catch on an edge of the open second end 115 and reduces the likelihood that the insert 1202 will compress and extend outwardly when pushed by the automated inserter 2002.

The insert conveyor 1806 transports the inserts 1202 toward the chutes 2004. The box conveyor 1811 transports the three-dimensional container bodies 802 toward the exit end of the chutes 2004. When the open second end 115 of a three-dimensional container body 802 and an insert holding tray 1904 are both correctly aligned with a chute 2004, which can be sensed via electronic eyes (not shown), the automated inserter 2002 can push the insert 1202 through the opening 1002 at the second end 115 and into the receiving cavity 1004 of the container 103. The automated inserter 2002 can utilize an arm, piston, actuator, or other pushing mechanism to push the insert 1202. The container 103 is now in a packed for outbound configuration 1208.

Figure 25A:
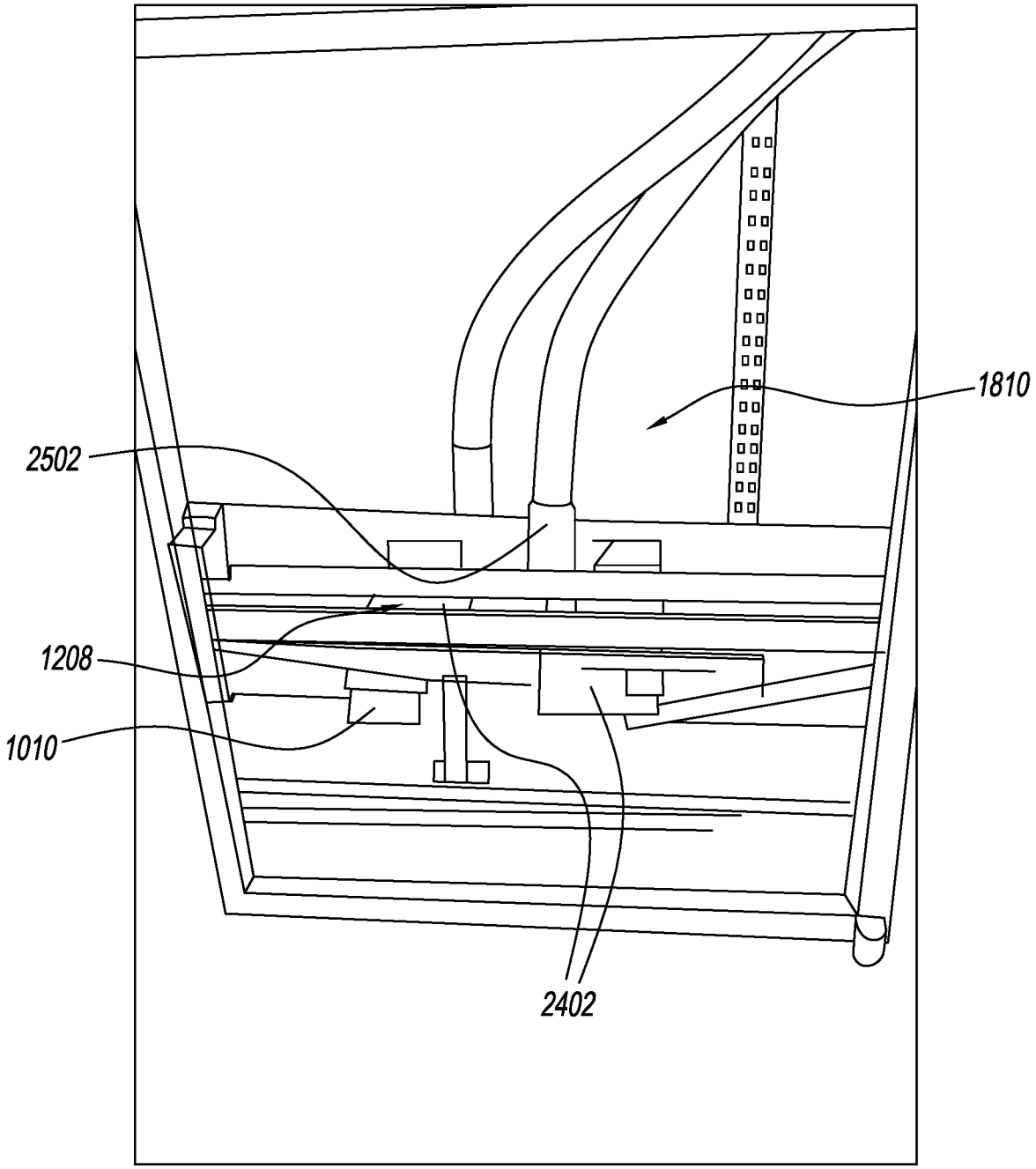
FIG. 25A depicts a frontal view of an exemplary gluer assembly of the EFG assembly, which folds the container panels at the open ends of the container and adhesively seals the ends to form a closed and packed container.
Figure 25B:
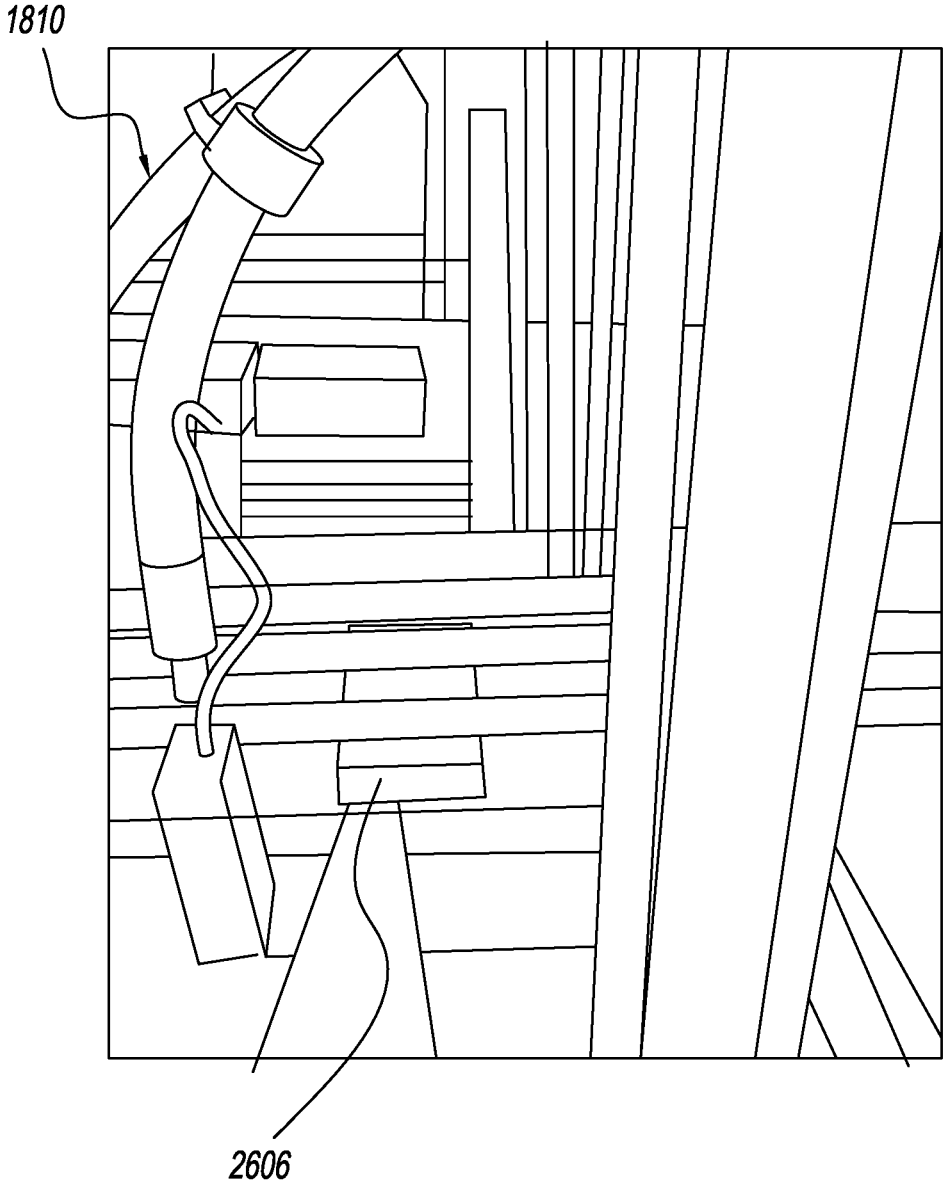
FIG. 25B depicts a closed and packed container formed by the gluer assembly.
Figure 26:
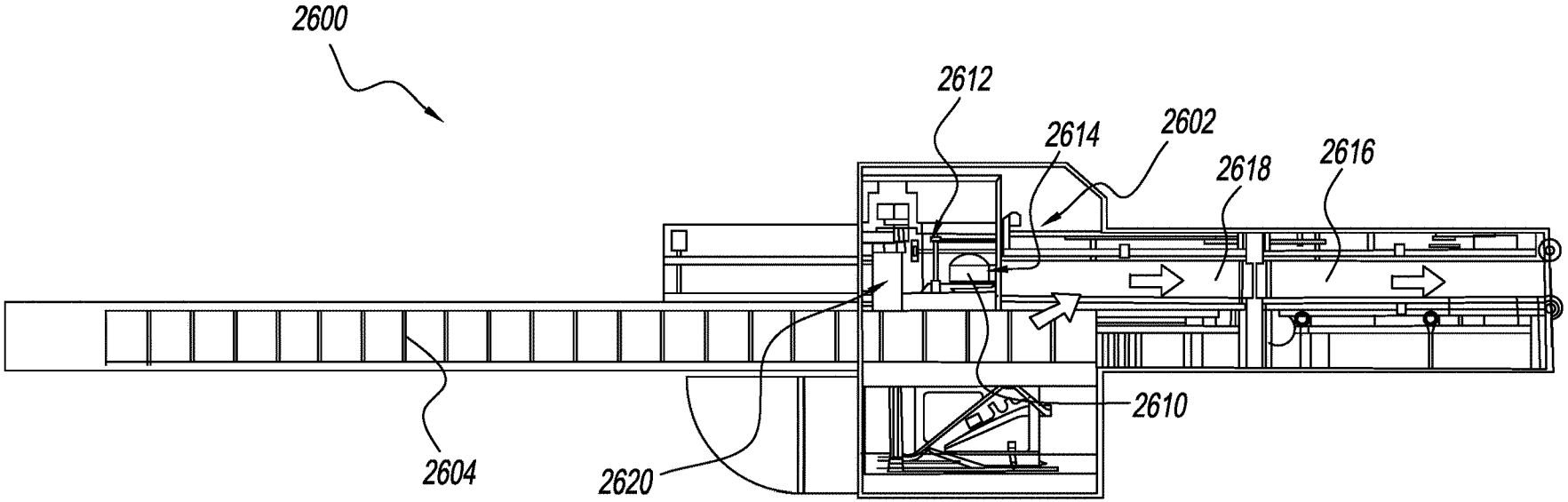
FIG. 26 depicts an exemplary labeling line which can apply the label of FIGS. 2A and 2B.

Referring now to FIGS. 18 and 25A-25B, a gluer assembly 1810 closes and seals the first end 113 and the second end 115 to form a closed and packed container 2606. The gluer assembly 1810 folds the wing panels 534 at the first end 113, the closure flap 111, and the first inner flap panel 538 toward the opening 902. The wing panels 534 at the second end 115 and the second inner end panel 536 are folded toward the opening 1002, which can be performed by the gluer assembly 1810 simultaneously along with the folding of the panels 538, 534 of the first end 113.

The gluer assembly 1810 includes adhesive applicators 2402 which apply adhesive to the adhesive receiving areas, as have been previously described. The gluer assembly adheres the distal segment 126 of the closure flap 111 to the bottom panel 104. The second end panel 110 is adhered by the gluer assembly 1810 with the second inner end panel 536. A closed and packed container 2606 has now been formed.

The closed and packed container 2606, which is a semi-finished mailing container 103 that does not yet include label 130 on an exterior thereof, is then conveyed 1716 to a box collection area. The closed and packed containers 2606 can be placed in warehouse inventory to provide containers 2606 during surge periods; however, the containers 2606 can be labeled directly from the EGF assembly 1800.

Referring now to FIGS. 26-38, an exemplary labeling line assembly 2600 will now be described. The containers 2606 can be moved from inventory and placed on the labeling line assembly 2600 to quickly have the labels 130 and pouches 132 adhered thereto.

As will be appreciated to a person of skill, having almost fully completed containers 2606 (e.g., merely lacking label 130 and pouch 132 relative the fully closed outbound configuration 107) provides for a greater output of containers 103 in a fully closed outbound configuration 107 at times of high demand, enabling more containers 103 to be shipped to first recipients over a given period of time. It is also important to note that the present processes described herein remove the need for the containers 103 to be hand-filled (e.g., especially with regard to inserts 1202).

The prior art process of placing a return label by hand into the interior of the box, then sealing the box, is no longer required. As will be appreciated, the overall output of containers 103 in a fully closed outbound configuration 107 has been enhanced significantly. Additionally, the overall costs of container 103 production are reduced due to the decrease of labor costs.

Referring back to FIG. 26, an exemplary labeling line assembly 2600 includes a container input conveyor 2604, a box feeder assembly 2620, a gluey bar 2612, a label applying assembly 2602 (which includes a label feeder assembly 2610 and a label applicator 2614), a line conveyor 2618, and a pouch applicator assembly 2616.

Figure 27:
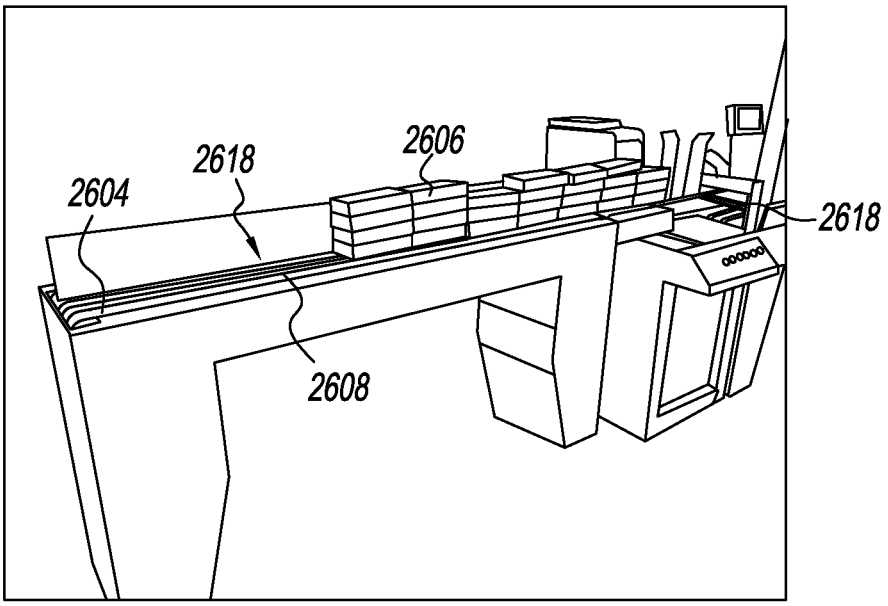
FIG. 27 is a perspective view of an exemplary staging area of the labeling line of FIG. 26.
Figure 28:
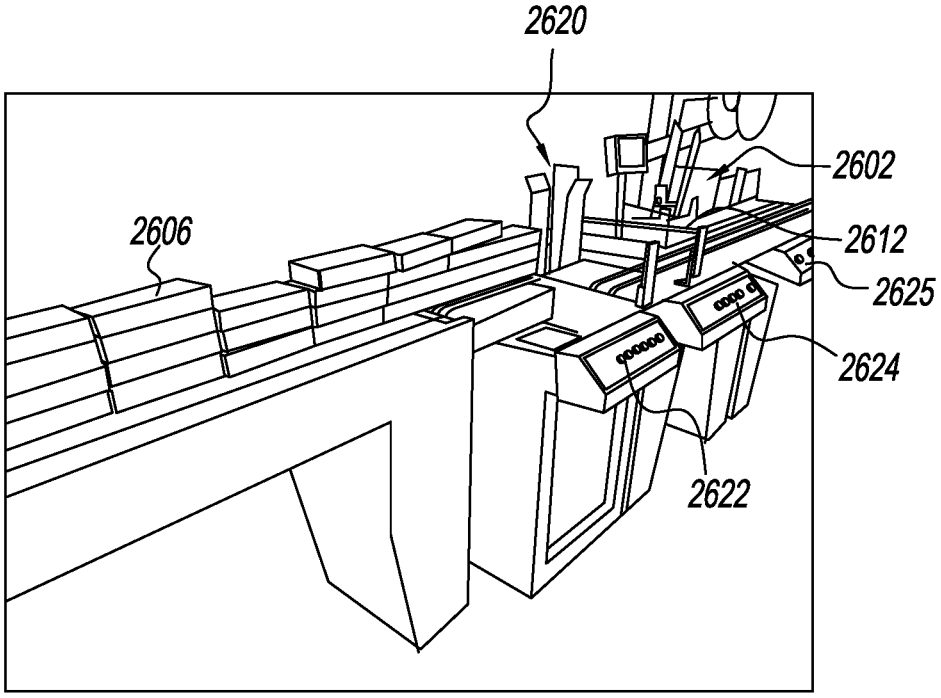
FIG. 28 depicts a perspective view of the labeling line, which illustrates an exemplary box feeder assembly, exemplary gluer bar, and exemplary controls.

Referring now to FIGS. 27 and 28, semi-finished containers 2606 are stacked in a holding area 2618. The containers 2606 are packed, closed, and sealed and awaiting application of a label 130 and pouch 132.

A container input conveyor 2604, which includes a conveyor belt 2608, moves the containers 2606 from the holding area 2618 toward a box feeder assembly 2620. The box feeder assembly 2620 feeds one container 2606 at a time onto the line conveyor 2618.

Figure 29:
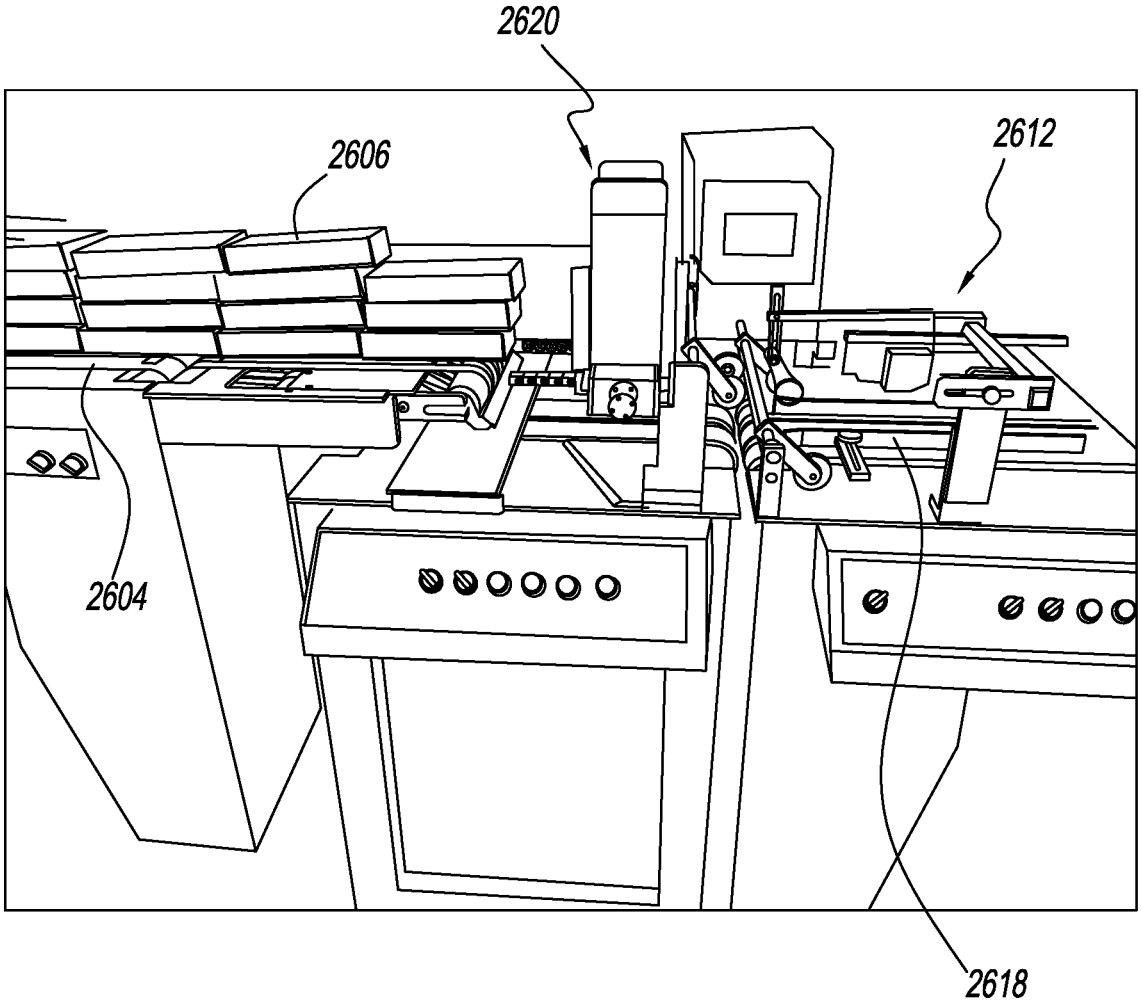
FIG. 29 depicts a side view of the box feeder assembly and gluer bar.
Figure 30:
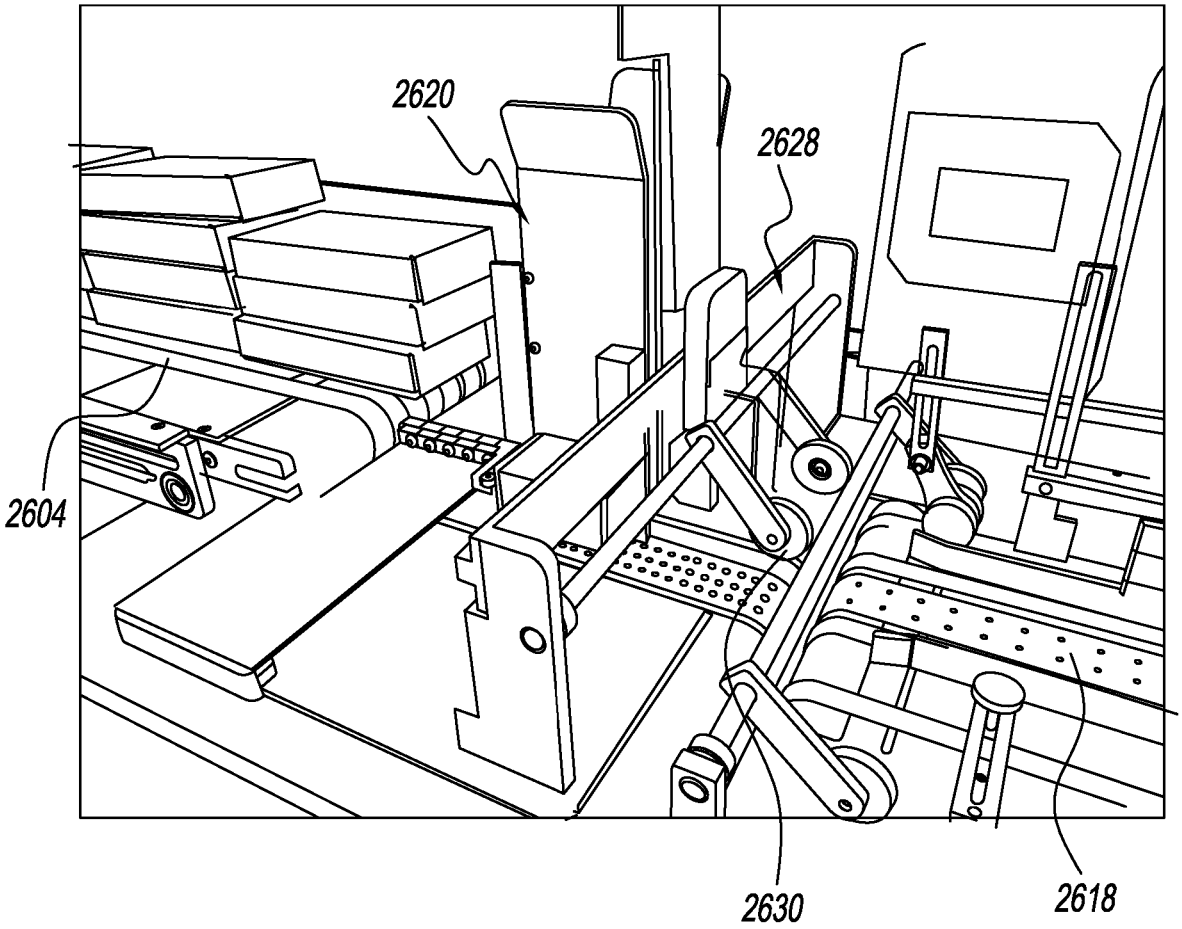
FIG. 30 depicts a further perspective view of the box feeder assembly and depicts an exemplary separator.
Figure 31:
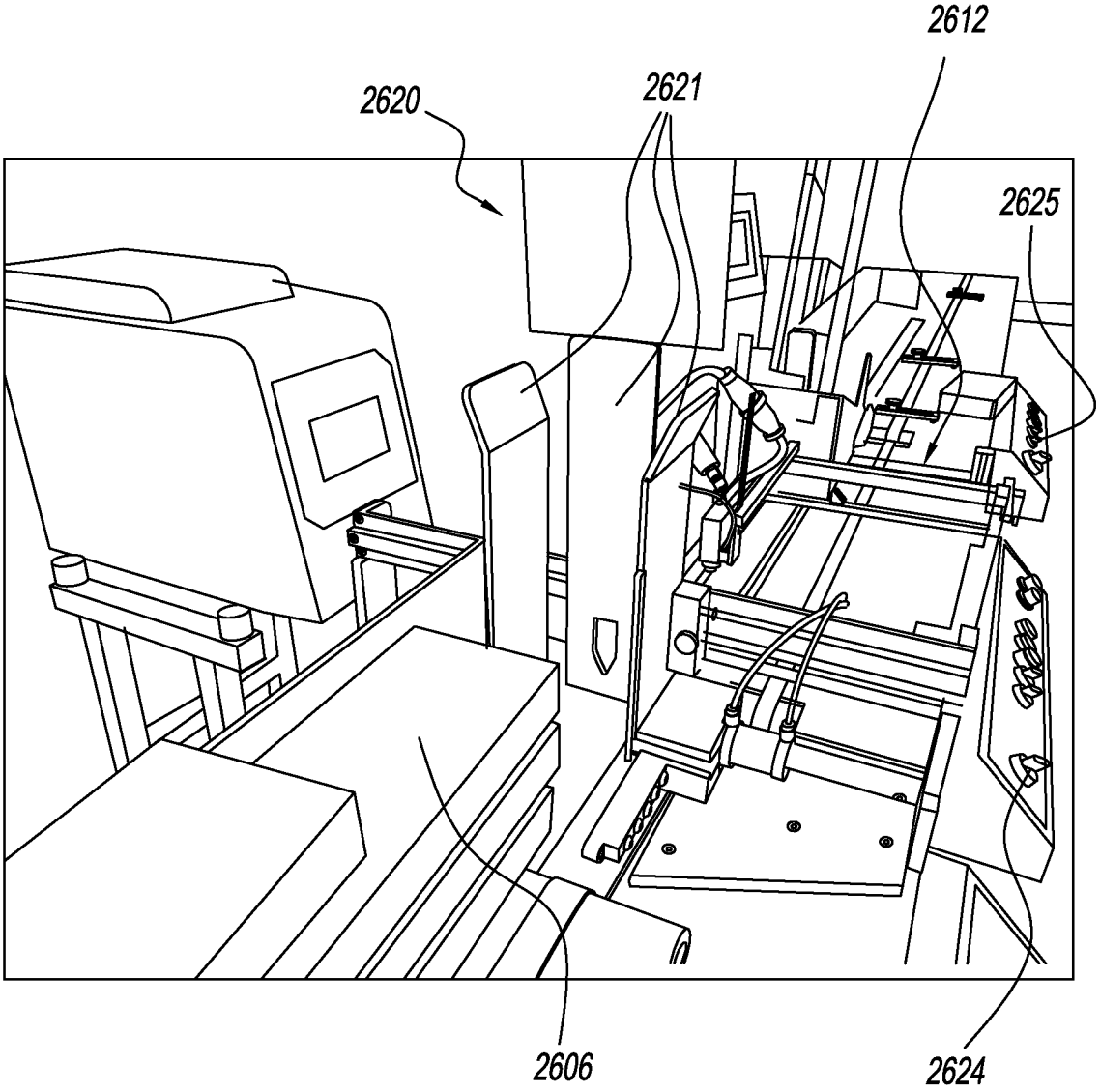
FIG. 31 depicts a further perspective view of the box feeder assembly and gluer bar.

Referring now to FIGS. 29-31, the container input conveyor 2605 moves the containers 2606, in an incremental batch fashion, toward the box feeder assembly 2620. The box feeder assembly 2620 is depicted as including feeding walls 2621 which retain the containers 2606 in an aligned stack. The feeding walls 2612 of the box feeder assembly 2620 are depicted as being a three-walled, substantially rectangular open trough for receiving the stacked containers 2606. The box feeder assembly 2620 then deposits the containers 2606, one at a time, onto the line conveyor 2618.

The box feeder assembly 2620 can include a separator 2628 and a pressure application wheel 2630, as is best shown in FIG. 30. The separator 2628 is designed to provide an adequate spacing between the containers 2606 as they are deposited on the line conveyor 2618.

The pressure application wheel 2630 takes the form of an arm having a wheel on a distal end thereof. The pressure application wheel 2630 applies pressure to the container 2606 to hold the container 2606 against the conveyor 1618. The pressure application wheel 2630 additionally ensures that only a single container 2606 is fed by the box feeder assembly 2620 at a time (e.g., ensuring that a stack of containers 2606 is not fed, which would result in a jam).

FIG. 30 also depicts exemplary controls 2622 for the box feeder assembly 2620, exemplary controls 2624 for the gluer bar 2612, and exemplary controls 2625 for the label applicator assembly 2602.

A glue applicator 2612, depicted as a gluer bar 2612, is located downstream of the box feeder assembly 2620 on the line conveyor 2618. This gluer bar 2612 is configured to place a droplet or two of glue on the top panel 102 of the container 2606, so as to hold the label 130 in place as the container 2606 moves down the conveyor 2618. These droplets of glue firmly hold the label 130 in place and prevent various environmental factors of the conveyor 2618 (e.g., wind from moving down the conveyor, shifting movements of the conveyor, etc.) from causing the label 130 to move on the container 2606 or to fall from the container 2606.

As has been described herein, the combined label 130 is removed by the first recipient and a second label portion 220 is employed by the first recipient as a return label (e.g., the second label portion 220 is peeled from the first label portion 200 and the second label portion 220 is adhered to the exterior 125 of the container 103). Therefore, the glue composition and amount of glue emitted by the gluer bar 2612 should not be such that the first recipient will tear or destroy the label 130 when attempting to remove the label from the top panel 102 of the container 103. Rather, the glue emitted by the gluer bar 2612 should have a gentle hold (e.g., which can be similar to the adhering strength found on a Post-It Note®, which is capable of adhering to a surface but can later be removed without tearing and/or removing the print from the surface when removed).

Figure 32:
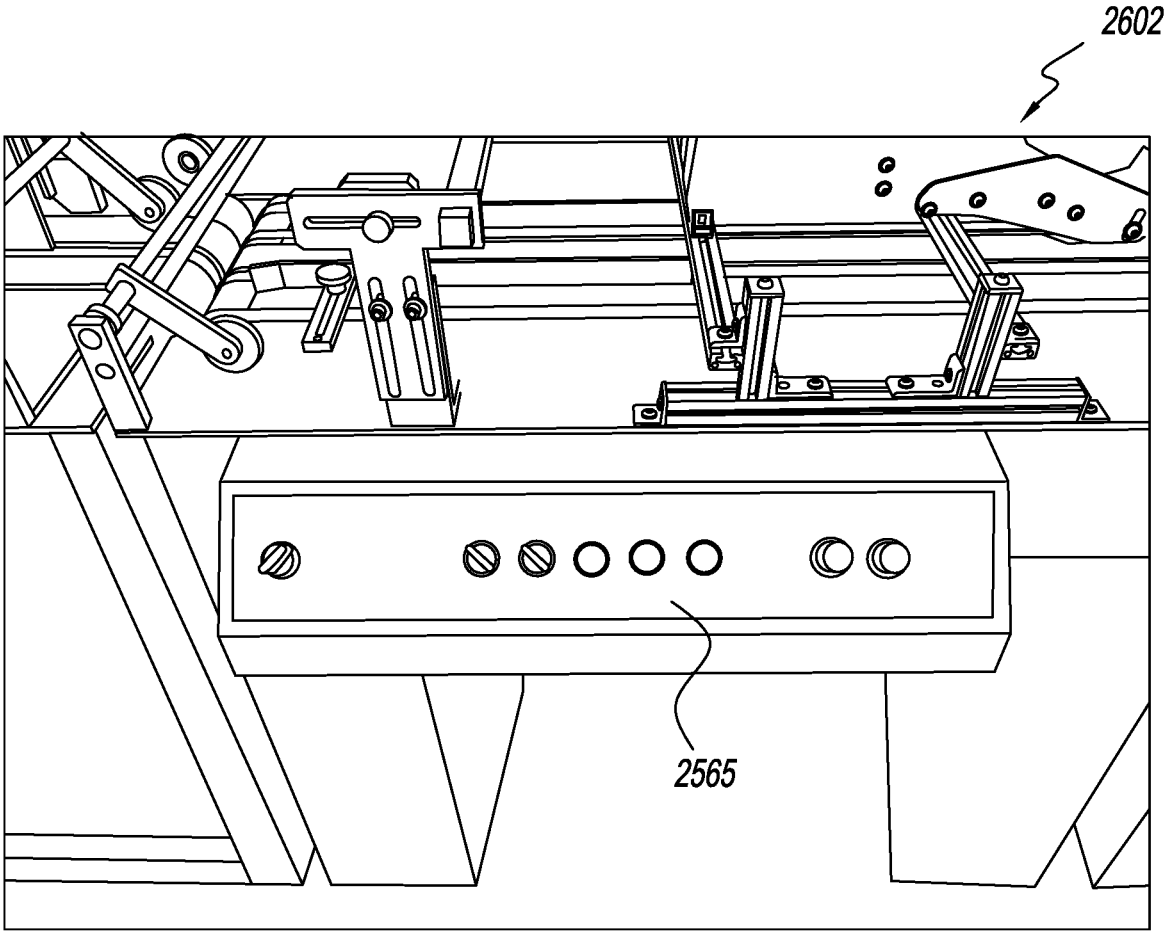
FIG. 32 depicts exemplary controls of the labeling line which are depicted as controlling an exemplary labeling assembly.
Figure 33:
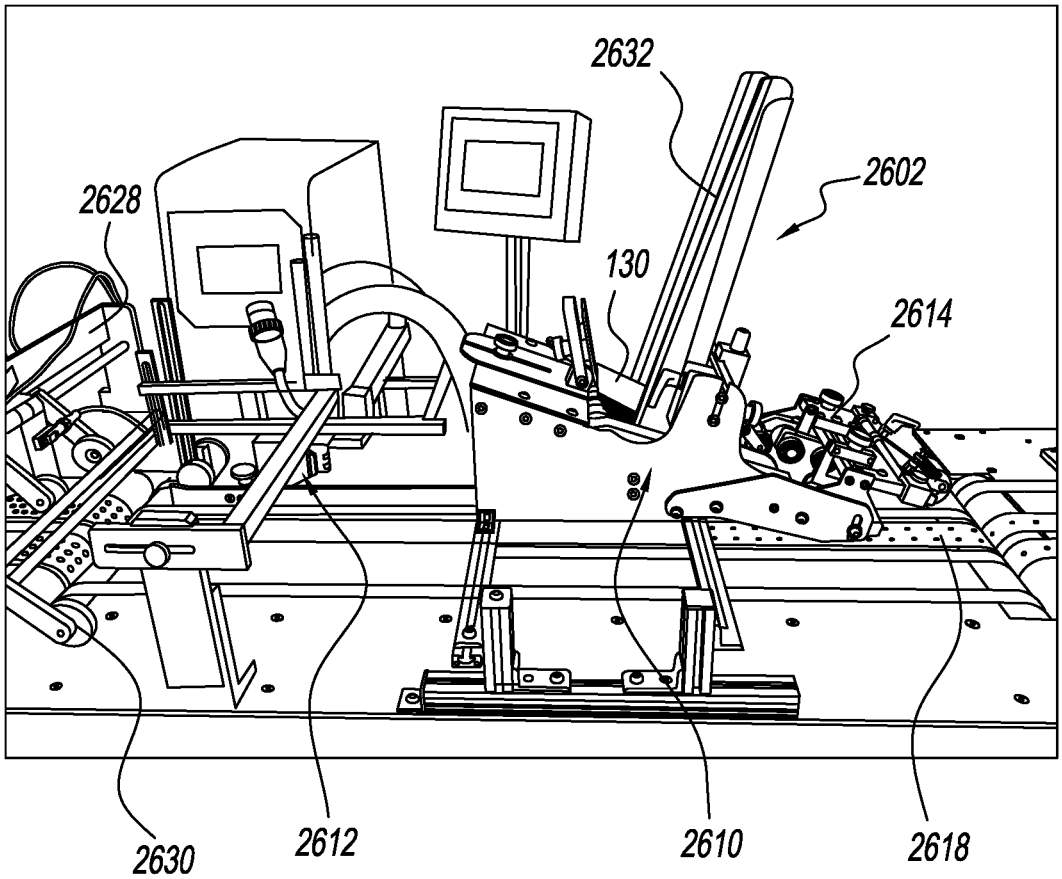
FIG. 33 depicts a side view of the labeling assembly of FIG. 32.
Figure 34:
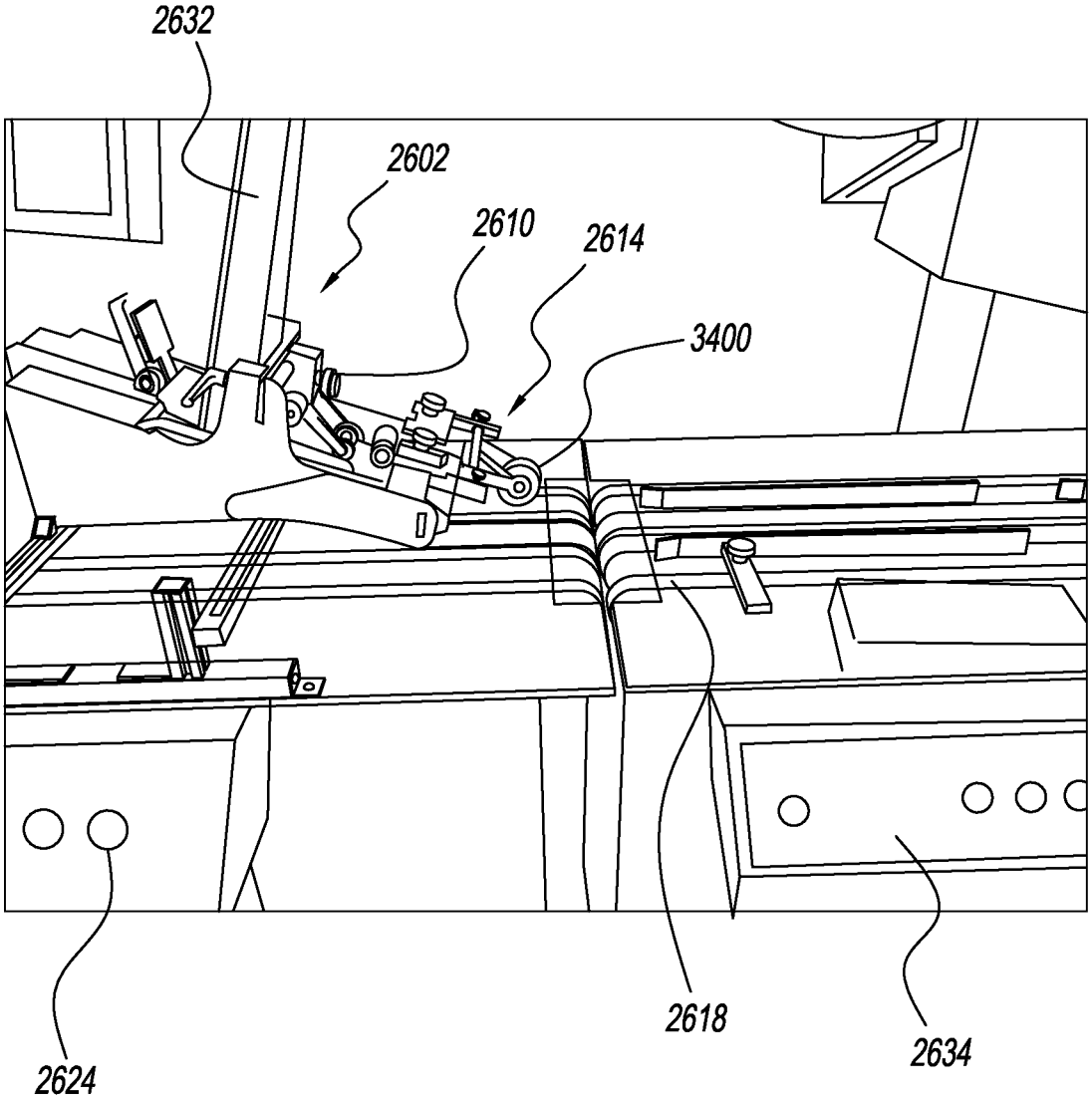
FIG. 34 depicts a further side view of the labeling assembly, illustrating the label applicator.
Figure 35:
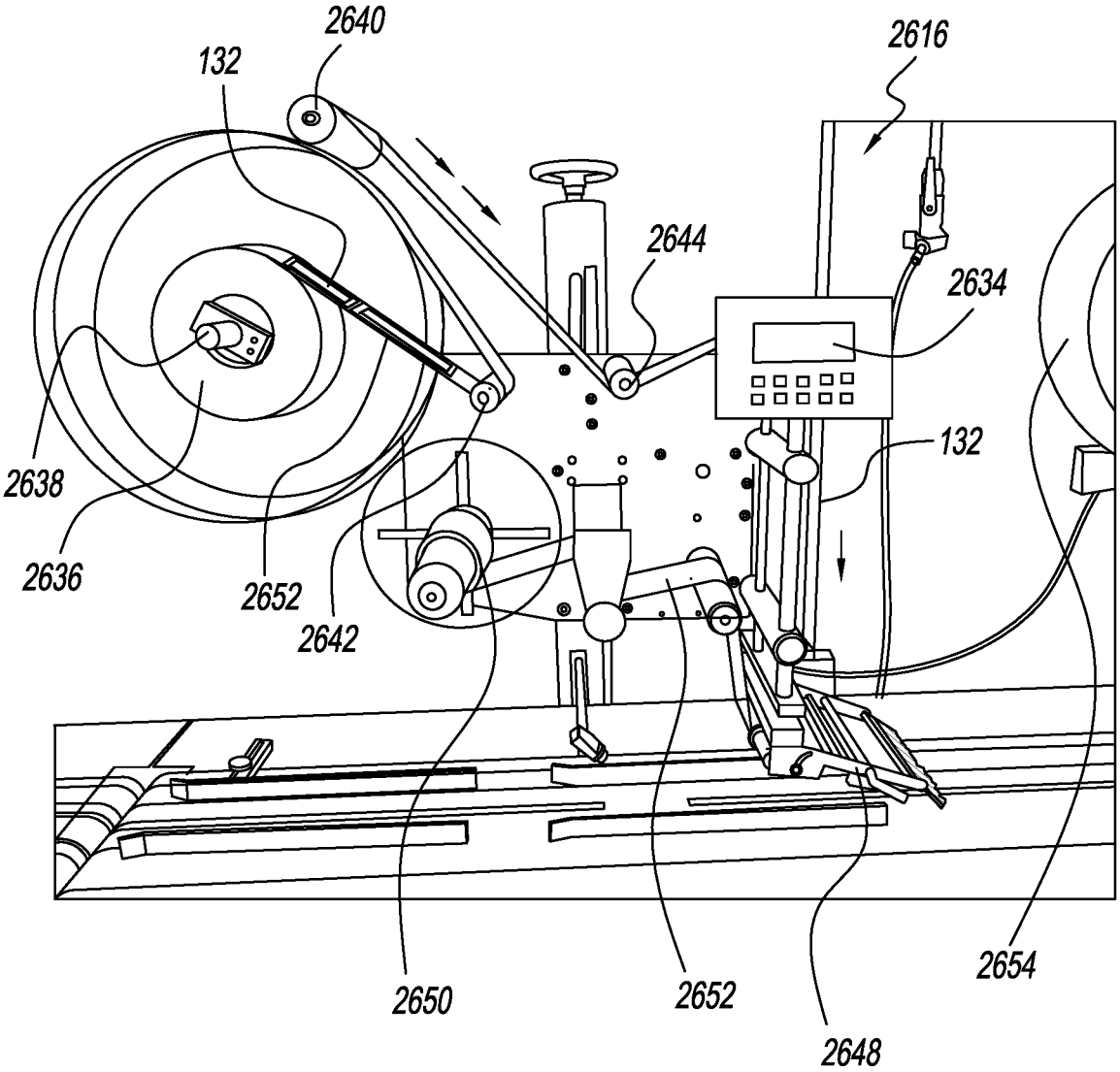
FIG. 35 depicts a side view of an exemplary pouch applicator assembly of the labeling line of FIG. 26.
Figure 36:
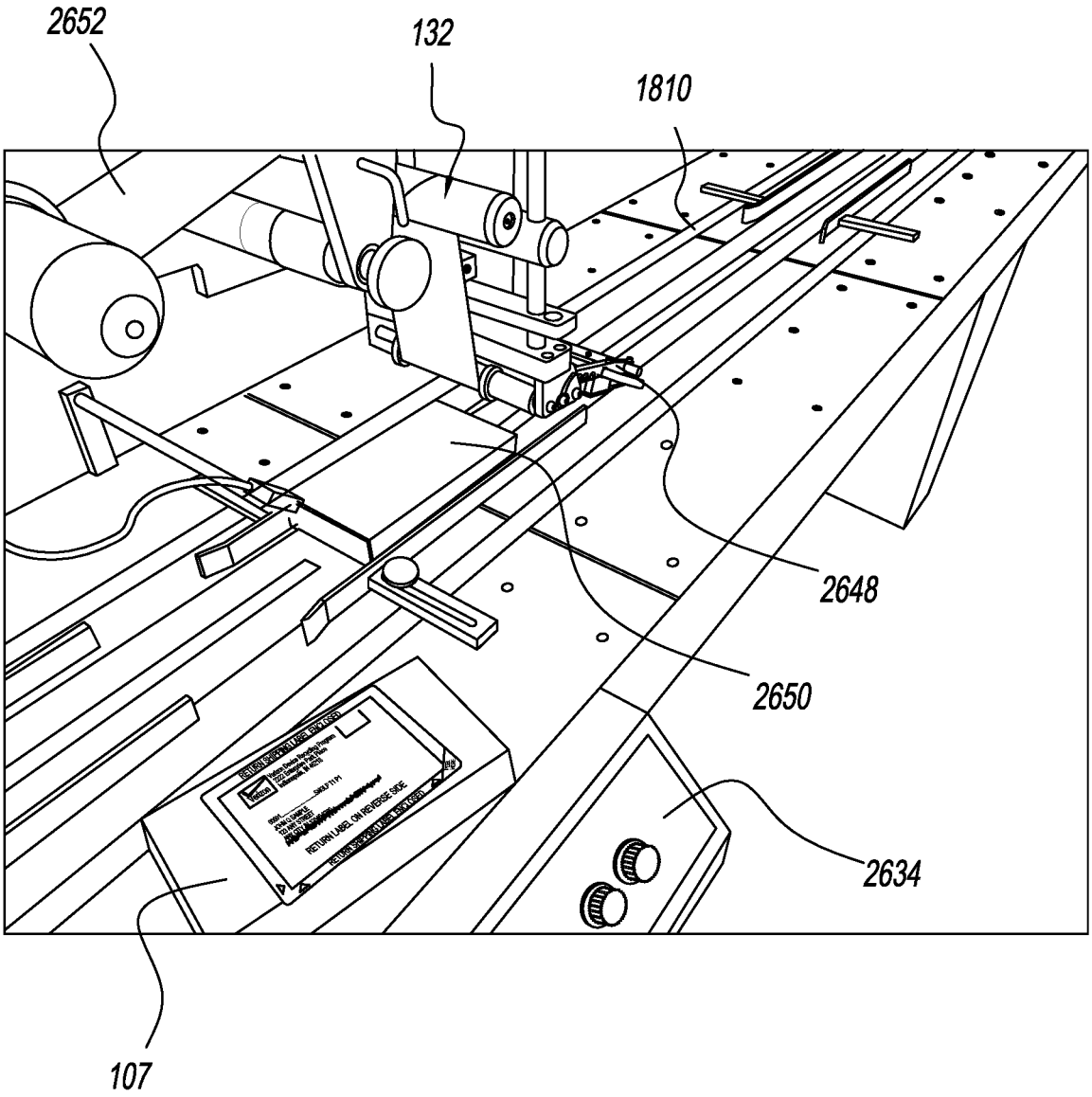
FIG. 36 is an overhead perspective view of the pouch applicator assembly of FIG. 35.
Figure 37:
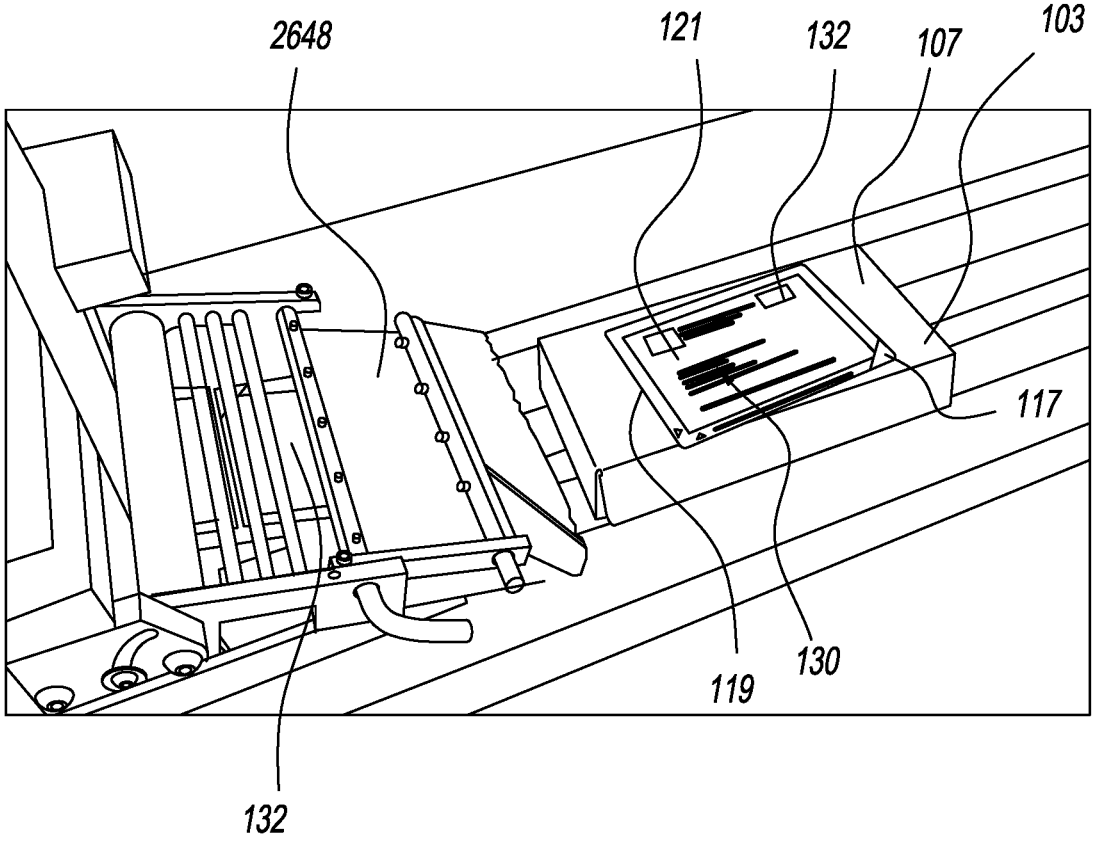
FIG. 37 depicts a perspective view of a fully assembled and labeled round trip container, illustrated in a closed outbound mailing configuration.
Figure 38:
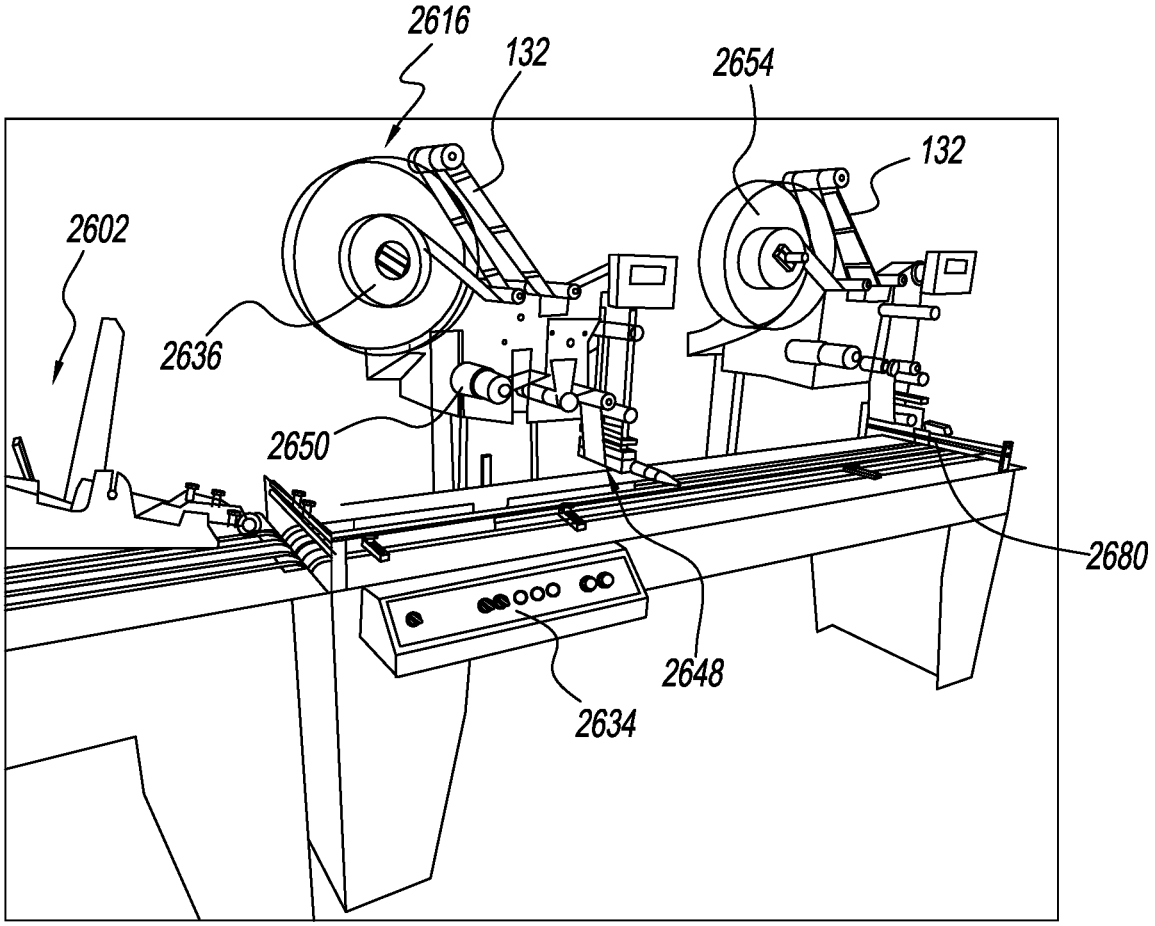
FIG. 38 depicts a perspective view of the pouch applicator assembly, which includes a backup pouch applicator assembly.

Referring now to FIGS. 32-34, the label applicator assembly 2602 will now be described. The label applicator assembly 2602 is located downstream of the gluer bar 2612 on the line conveyor 2618. The label applicator assembly 2602, which is best shown in FIG. 33, includes a label supply stacker 2632, a label feeder 2610, and a label applicator 2614.

Stacked labels 130 are placed into the label supply stacker 2632. The label feeder 2610 receives the labels from the supply stacker 2632 and provides them, in a singular fashion, to the label applicator 2614. The label feeder 2610 is depicted as a Straight Shooter® brand label feeder 2610; however, it is contemplated that a variety of label feeders 2610 can be utilized to feed the labels 130 to the label applicator 2614.

The label feeder 2610 moves the labels 130 from the stack at the supply stacker 2632 and positions the label such that the label applicator 2614 can apply the label to the top panel 102 of the container 2606. The label applicator 2614 can include a pressing mechanism, shown as pressing wheel 3400, which serves to press the label 130 firmly against the glue drops which the gluer bar 2612 deposited on the top panel of the container 2606.

The label applicator 2614 is oriented relative to the containers 2606 on the conveyor 2618 so that the labels 130 are applied to the top panels 102 of the containers 2606 in a substantially uniform and even manner. The uniformity of label 130 application by the label applicator 2614 is especially important as a pouch 132 will be applied over the label, as will be described hereinafter.

Referring now to FIGS. 35-38, an exemplary pouch applicator assembly 2616 will be described. The pouch applicator assembly 2616 is located downstream of the label applicator 2614. The pouch applicator assembly 2616 is depicted as including a pouch 132 supply roll 2636, a substrate take up reel 2650, a number of rollers 2640, 2642, and 2644, and a pouch applicator 2648. The pouch applicator assembly 2616 is configured to apply a pouch 132 over the label 130 which firmly retains the label 130 to the top panel 102.

As has been briefly described, the pouches 132 are not entirely covered with. Rather, the adhesive is only applied to a perimeter 119 of the pouch 132. The viewing window 121, which is depicted as fully covering the label 130, is adhesive-free and transparent. Therefore, the label 130 can be easily seen through the viewing window 121 and the label 130 will not stick to the pouch 132 when the first recipient opens the pouch 132 via tab 117 to remove the label 130 therefrom.

The pouches 132 are applied to an easy release substrate 2652. The pouches 132 and substrate 2652 can be viewed as taking a peel and stick form (e.g., the pouches 132 are peeled from the substrate 2652 to be adhered over the label 130). The pouches 132 can be provided on the substrate 2652 in the form of a pouch 132 supply roll 2636. As the substrate 2652 is pulled toward the pouch applicator 2648, the pouch 132 supply roll 2636 rotates around the spool roller 2638. The pouches 132 and substrate 2652 then traverse a series of rollers 2642, 2640, and 2644 prior to arrival at the pouch applicator 2648. These rollers 2642, 2640, and 2644 ensure that the substrate 2652 is maintained in tension, and one or more of the rollers 2642, 2640, and 2644 may be drive rollers (e.g., providing a motive force to the substrate 2652).

The pouch applicator 2648 is located just above the containers 2606 on the line conveyor 2618. The pouch applicator 2648 peels a pouch 132 from the substrate 2652 and the pouch applicator 2648 presses the adhesive on the perimeter 119 of the pouch 132 on the top panel 102 around the label 130. A properly positioned pouch 132 is located over the label 130 so that the label 130 is placed within the confines of viewing window 121 of the pouch 132 and is visible therethrough. The adhesive on the outer perimeter 119 of the pouch 132 preferably does not contact the label 130.

Once the pouch 132 has been applied over the label 130 onto the top panel 102, the now empty substrate 2652 (e.g., as the pouch 132 was peeled therefrom) is spooled around a substrate take up reel 2650.

A controller 2634 is utilized to control the pouch applicator assembly 2616. A back-up pouch applicator assembly 2654 is provided. The pouch applicator assembly 2616 and the back-up pouch applicator assembly 2654 operate in a similar fashion to a primary and back-up projector in a movie theater. Specifically, the pouch applicator assembly 2616 will feed and apply pouches 132 on containers 2606 until its supply reel 2636 runs out of pouches 132 and is empty. At that point, the back-up pouch applicator assembly 2654 takes over, continuing to apply pouches 132 over the labels 130 on the containers 2606 until its supply reel 2680 is also exhausted.

When the back-up pouch applicator assembly 2654 is operating, the supply reel 2636 of the pouch applicator assembly 2616 can be replaced. This replacement preferably occurs prior to the supply reel 2680 of the back-up pouch applicator assembly 2654 running out of pouches 132. In this manner, the pouch applicator assembly 2616 and the back-up pouch applicator assembly 2654 allow for the application of pouches 132 when the respective supply reels 2636 and 2680 are replaced, enabling continued run time of the labeling line assembly 2600. This is believed to be highly advantageous as the labeling line assembly 2600 is highly automated; therefore, humans may not frequently be present at the labeling line assembly 2600 to provide for frequent supply reel 2636 and 2680 changes.

After the pouch 132 has been applied over the label 130 with the perimeter 119 adhered to the top panel 102, the container 103 is in the fully closed outbound mailing configuration 107, as is depicted in FIGS. 1-2. This finished container 103 is ready to be mailed from the first user to the first recipient as has been previously described.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law.

Furthermore, it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A round trip mailing container, comprising:

a container body defining a receiving cavity, a top panel devoid of an adhesive receiving area and an adhesive portion, and a bottom panel opposite the top panel, the bottom panel having a first end and a second end, wherein an opening in the container body provides access to the receiving cavity;

a resealable closure flap configured to extend over the opening, wherein a proximal end of the closure flap is operably coupled with the first end of the top panel of the container body;

a first adhesive receiving area located at the resealable closure flap, wherein the first adhesive receiving area is configured to receive adhesive to adhere the closure flap to the container body at an exterior of the bottom panel when the container is placed in a first closed configuration;

an adhesive portion located on the resealable closure flap, wherein a removable covering is disposed over the adhesive portion when the container is placed in the first closed configuration, and wherein the adhesive portion is configured to adhere the closure flap to the container body at an exterior of an inner end panel when the container is placed in a second closed configuration, wherein the inner end panel is operably coupled with the first end of the bottom panel;

wherein the resealable closure flap includes a proximal segment and a distal segment, wherein the first adhesive receiving area is located at the distal segment, and wherein the adhesive portion is located at the proximal segment; and a release located at the closure flap between the first adhesive receiving area and the adhesive portion.

2. The container of claim 1, wherein the release further comprises a pull-tab tear away strip, and wherein tearing of the pull-tab tear away strip separates the distal segment from the proximal segment and enables access to the receiving cavity.

3. The container of claim 2, wherein the container body has a substantially rectangular-cuboid shape, wherein the proximal end of the closure flap is foldably coupled to the top panel, wherein the proximal segment of the closure flap defines the first end of the bottom panel of the container body, and wherein the container body further includes a first side panel, a second side panel, and a second end panel opposite a first end panel.

4. The container of claim 3, wherein an adhesive located on the first adhesive receiving area adheres the distal segment of the closure flap to the bottom panel.

5. The container of claim 1, further comprising a padded insert assembly configured for insertion into the receiving cavity.

6. The container of claim 5, wherein the padded insert assembly includes two horizontally extending pads which are affixed to and extend between two opposing walls, and wherein the padded insert assembly is configured for mechanized insertion into the receiving cavity.

7. The container of claim 1, further comprising a round trip mailing label, having:

a first label portion having a face surface that includes first shipment information;

a second label portion having a second face surface configured to have second shipment information printed thereon;

an adhesive located at the second label portion, wherein the adhesive releasably adheres the second label portion to the first label portion, and wherein the second label portion is configured to be removed from the first label portion and adhered to the container.

8. The container of claim 7, further comprising a transparent pouch configured to retain the first label portion and the second label portion to the container.

9. The apparatus of claim 1 further comprising:

a first label portion having a face surface configured to have first shipment information printed thereon;

a second label portion having a second face surface configured to have second shipment information printed thereon; and an adhesive disposed on the second label portion, wherein the adhesive releasably adheres the second label portion with the first label portion to form a combined label, and wherein the second label portion is configured to be removed from the first label portion and adhered to a container.

10. The apparatus of claim 9, further comprising:

a pouch configured to retain the combined label to the container; and a viewing window located in the pouch, and wherein the face surface is oriented to be visible trough the viewing window.

11. The apparatus of claim 10, wherein an outer perimeter of the pouch is adhered to the container, and wherein the pouch extends over and covers the combined label.

12. The apparatus of claim 10, wherein the pouch is configured to enable combined label to be removed therefrom absent tearing the second label portion.

13. The apparatus of claim 9, wherein a lower surface of the first label portion includes a release backing, wherein the adhesive is located on a second lower surface of the second label portion, and wherein the face surface and the second face surface each face outwardly from the combined label on opposing sides thereof.

14. A round trip mailing container, comprising:

a container body defining a receiving cavity, a top, and a bottom panel opposite the top panel, the bottom panel having a first end and a second end, wherein an opening in the container body provides access to the receiving cavity;

a resealable closure flap configured to extend over the opening, wherein a proximal end of the closure flap is operably coupled with the first end of the top panel of the container body, wherein the closure flap includes a proximal segment and a distal segment, and a release located at the closure flap between the proximal and distal segments, wherein the release further comprises a pull-tab tear away strip, configured so that tearing of the pull-tab tear away strip separates the distal segment from the proximal segment and enables access to the receiving cavity, a first adhesive receiving area located at the distal segment, and wherein the adhesive portion is located at the proximal segment of the resealable closure flap, wherein the first adhesive receiving area is configured to receive adhesive to adhere the closure flap to the container body at an exterior of the bottom panel when the container is placed in a first closed configuration; and an adhesive portion located at the proximal segment, wherein a removable covering is disposed over the adhesive portion when the container is placed in the first closed configuration, and wherein the adhesive portion is configured to adhere the closure flap to the container body at an exterior of an inner end panel when the container is placed in a second closed configuration, wherein the inner end panel is operably coupled with the first end of the bottom panel, wherein a removable covering is disposed over the adhesive portion when the container is placed in the first closed configuration, and wherein the adhesive portion is configured to adhere the closure flap to the container body when the container is placed in a second closed configuration, wherein the container body has a substantially rectangular-cuboid shape, wherein the proximal end of the closure flap is foldably coupled to the top panel, wherein the proximal segment of the closure flap defines the first end of the bottom panel of the container body, and wherein the container body further includes a first side panel, a second side panel, and a second end panel opposite a first end panel, further comprising an inner panel extending upwardly from the bottom panel at the opening, wherein after opening the container with the pull-tab tear away strip, the removable covering is removed from the adhesive portion and the adhesive portion adheres the proximal segment to the inner panel, thereby placing the container in the second closed configuration.

15. A round trip mailing container, comprising:

a container body having a substantially rectangular-cuboid shape, and defining a receiving cavity, wherein an opening in the container body provides access to the receiving cavity;

a resealable closure flap configured to extend over the opening, wherein a proximal end of the closure flap is operably coupled with the container body;

a first adhesive receiving area located at the closure flap, wherein the first adhesive receiving area is configured to receive adhesive to adhere the closure flap to the container body when the container is placed in a first closed configuration; and a second adhesive portion located on the closure flap, wherein a removable covering is disposed over the second adhesive portion when the container is placed in the first closed configuration, and wherein the second adhesive portion is configured to adhere the closure flap to the container body when the container is placed in a second closed configuration;

wherein the closure flap includes a proximal segment and a distal segment, wherein the first adhesive receiving area is located at the distal segment, and wherein the adhesive portion is located at the proximal segment; and further comprising a release located at the closure flap between the proximal segment and the distal segment, the release including a pull-tab tear away strip, and wherein tearing of the pull-tab tear away strip separates the distal segment from the proximal segment and enables access to the receiving cavity;

wherein the proximal end of the closure flap is foldably coupled to the top panel, wherein the proximal segment of the closure flap defines a first end of the container body, and wherein the container body further includes a top panel, a bottom panel, a first side panel, a second side panel, and a second end panel opposite the first end;

wherein an adhesive located on the first adhesive receiving area adheres the distal segment of the closure flap to an exterior of the bottom panel; and further comprising an inner side panel extending upwardly from the bottom panel at the opening, the inner side panel being adhesively coupled to the first side panel for thereby coupling the first side panel to the bottom panel, wherein after opening the container with the pull-tab tear away strip, the removable covering is removed from the adhesive portion and the adhesive portion adheres the proximal segment to the inner panel, thereby placing the container in the second closed configuration.

* * * * *